US009715978B2

(12) United States Patent
Hendren

(10) Patent No.: US 9,715,978 B2
(45) Date of Patent: Jul. 25, 2017

(54) LOW TRAVEL SWITCH ASSEMBLY

(71) Applicant: Apple Inc., Cupertino, CA (US)

(72) Inventor: Keith J. Hendren, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 2 days.

(21) Appl. No.: 14/660,163

(22) Filed: Mar. 17, 2015

(65) Prior Publication Data

US 2015/0348726 A1 Dec. 3, 2015

Related U.S. Application Data

(60) Provisional application No. 62/003,455, filed on May 27, 2014.

(51) Int. Cl.

*H01H 13/85* (2006.01)
*H01H 13/7073* (2006.01)
*H01H 3/12* (2006.01)

(52) U.S. Cl.

CPC ..... *H01H 13/85* (2013.01); *H01H 13/7073* (2013.01); *H01H 3/125* (2013.01); *H01H 2215/006* (2013.01); *H01H 2215/028* (2013.01)

(58) Field of Classification Search

CPC ..... H01H 13/85; H01H 1/10; H01H 13/14; H01H 5/18
USPC ..... 200/5 A, 406
See application file for complete search history.

(56) References Cited

U.S. PATENT DOCUMENTS 3,657,492 A 4/1972 Arndt et al.
3,917,917 A 11/1975 Murata
4,095,066 A 6/1978 Harris
4,319,099 A 3/1982 Asher
4,349,712 A 9/1982 Michalski
4,484,042 A 11/1984 Matsui
4,937,408 A 6/1990 Hattori et al.
(Continued)

FOREIGN PATENT DOCUMENTS

CN 2155620 2/1994
CN 2394309 8/2000
(Continued)

OTHER PUBLICATIONS

International Search Report and Written Opinion, PCT/US2014/039609, 11 pages, Sep. 18, 2014.
(Continued)

*Primary Examiner* — Edwin A. Leon
*Assistant Examiner* — Iman Malakooti
(74) *Attorney, Agent, or Firm* — Brownstein Hyatt Farber Schreck, LLP

(57) ABSTRACT

A key of a keyboard and a low travel dome switch utilized in the key. The key may comprise a key cap, and a low travel dome positioned beneath the key cap, and operative to collapse when a force is exerted on the low travel dome by the key cap. The low travel dome may comprise a top portion, and a group of arms extending from the top portion to a perimeter of the low travel dome and at least partially defining a tuning member located between two of the group of arms. The low travel dome may also comprise a group of elongated protrusions. Each of the group of elongated protrusions may extend from one of the top portion, or one of the group of arms. At least one of the group of elongated protrusions may extend into the tuning member.

20 Claims, 14 Drawing Sheets

(56) References Cited

U.S. PATENT DOCUMENTS 5,136,131 A 8/1992 Komaki
5,278,372 A 1/1994 Takagi et al.
5,340,955 A 8/1994 Calvillo et al.
5,382,762 A 1/1995 Mochizuki
5,421,659 A 6/1995 Liang
5,422,447 A 6/1995 Spence
5,457,297 A 10/1995 Chen
5,481,074 A 1/1996 English
5,504,283 A 4/1996 Kako et al.
5,512,719 A 4/1996 Okada et al.
5,625,532 A 4/1997 Sellers
5,804,780 A 9/1998 Bartha
5,828,015 A 10/1998 Coulon
5,847,337 A 12/1998 Chen
5,874,700 A 2/1999 Hochgesang
5,878,872 A 3/1999 Tsai
5,935,691 A 8/1999 Tsai
5,986,227 A 11/1999 Hon
6,020,565 A 2/2000 Pan
6,215,420 B1 4/2001 Harrison et al.
6,257,782 B1 7/2001 Maruyama et al.
6,388,219 B2 5/2002 Hsu et al.
6,482,032 B1 11/2002 Szu et al.
6,542,355 B1 4/2003 Huang
6,556,112 B1 4/2003 Van Zeeland et al.
6,559,399 B2 5/2003 Hsu et al.
6,572,289 B2 6/2003 Lo et al.
6,624,369 B2 9/2003 Ito et al.
6,759,614 B2 7/2004 Yoneyama
6,762,381 B2 7/2004 Kunthady et al.
6,797,906 B2 9/2004 Ohashi
6,850,227 B2 2/2005 Takahashi et al.
6,940,030 B2 9/2005 Takeda et al.
6,977,352 B2 12/2005 Oosawa
6,987,466 B1 1/2006 Welch et al.
7,012,206 B2 3/2006 Oikawa
7,129,930 B1 10/2006 Cathey et al.
7,134,205 B2 11/2006 Bruennel
7,151,236 B2 12/2006 Ducruet et al.
7,154,059 B2 12/2006 Chou
7,172,303 B2 2/2007 Shipman et al.
7,301,113 B2 11/2007 Nishimura et al.
7,378,607 B2 5/2008 Koyano et al.
7,414,213 B2 8/2008 Hwang
7,429,707 B2 9/2008 Yanai et al.
7,432,460 B2 10/2008 Clegg
7,510,342 B2 3/2009 Lane et al.
7,531,764 B1 5/2009 Lev et al.
7,541,554 B2 6/2009 Hou
7,639,187 B2 12/2009 Caballero et al.
7,781,690 B2 8/2010 Ishii
7,813,774 B2 10/2010 Perez-Noguera
7,842,895 B2 11/2010 Lee
7,847,204 B2 12/2010 Tsai
7,851,819 B2 12/2010 Shi
7,866,866 B2 1/2011 Wahlstrom
7,999,748 B2 8/2011 Ligtenberg et al.
8,063,325 B2 11/2011 Sung et al.
8,080,744 B2 12/2011 Yeh et al.
8,109,650 B2 2/2012 Chang et al.
8,119,945 B2 2/2012 Lin
8,124,903 B2 2/2012 Tatehata et al.
8,134,094 B2 3/2012 Tsao et al.
8,156,172 B2 4/2012 Muehl et al.
8,178,808 B2 5/2012 Strittmatter et al.
8,212,160 B2 7/2012 Tsao
8,212,162 B2 7/2012 Zhou
8,218,301 B2 7/2012 Lee
8,232,958 B2 7/2012 Tolbert
8,253,052 B2 8/2012 Chen
8,263,887 B2 9/2012 Chen et al.
8,289,280 B2 10/2012 Travis
8,299,382 B2 10/2012 Takemae et al.
8,319,298 B2 11/2012 Hsu
8,330,725 B2 12/2012 Mahowald et al.
8,354,629 B2 1/2013 Lin
8,378,857 B2 2/2013 Pance
8,384,566 B2 2/2013 Bocirnea
8,436,265 B2 5/2013 Koike et al.
8,451,146 B2 5/2013 Mahowald et al.
8,462,514 B2 6/2013 Myers et al.
8,500,348 B2 8/2013 Dumont et al.
8,502,094 B2 8/2013 Chen
8,542,194 B2 9/2013 Akens et al.
8,569,639 B2 10/2013 Strittmatter
8,592,699 B2 11/2013 Kessler et al.
8,592,702 B2 11/2013 Tsai
8,592,703 B2 11/2013 Johnson et al.
8,604,370 B2 12/2013 Chao
8,629,362 B1 1/2014 Knighton et al.
8,651,720 B2 2/2014 Sherman et al.
8,659,882 B2 2/2014 Liang et al.
8,731,618 B2 5/2014 Jarvis et al.
8,748,767 B2 6/2014 Ozias et al.
8,759,705 B2 6/2014 Funakoshi et al.
8,760,405 B2 6/2014 Nam
8,791,378 B2 7/2014 Lan
8,835,784 B2 9/2014 Hirota
8,847,711 B2 9/2014 Wright et al.
8,853,580 B2 10/2014 Chen
8,854,312 B2 10/2014 Meierling
8,870,477 B2 10/2014 Merminod et al.
8,976,117 B2 3/2015 Krahenbuhl et al.
9,012,795 B2 4/2015 Niu et al.
9,029,723 B2 5/2015 Pegg
9,063,627 B2 6/2015 Yairi et al.
9,064,642 B2 6/2015 Welch et al.
9,086,733 B2 7/2015 Pance
9,087,663 B2 7/2015 Los
9,093,229 B2 7/2015 Leong et al.
9,213,416 B2 12/2015 Chen
9,223,352 B2 12/2015 Smith et al.
9,234,486 B2 1/2016 Das et al.
9,275,810 B2 3/2016 Pance et al.
9,300,033 B2 3/2016 Han et al.
9,443,672 B2 9/2016 Martisauskas
2002/0079211 A1 6/2002 Katayama et al.
2002/0093436 A1 7/2002 Lien
2003/0169232 A1 9/2003 Ito
2004/0257247 A1 12/2004 Lin et al.
2006/0011458 A1 1/2006 Purcocks
2006/0096847 A1* 5/2006 Nishimura ..... H01H 13/48 200/406
2006/0120790 A1 6/2006 Chang
2006/0181511 A1 8/2006 Woolley
2006/0243987 A1 11/2006 Lai
2007/0200823 A1 8/2007 Bytheway et al.
2007/0285393 A1 12/2007 Ishakov
2008/0136782 A1 6/2008 Mundt et al.
2009/0103964 A1 4/2009 Takagi et al.
2009/0128496 A1 5/2009 Huang
2010/0066568 A1 3/2010 Lee
2010/0253630 A1 10/2010 Homma et al.
2011/0032127 A1 2/2011 Roush
2011/0056817 A1 3/2011 Wu
2011/0056836 A1 3/2011 Tatebe et al.
2011/0203912 A1* 8/2011 Niu ..... H01H 3/125 200/341
2011/0205179 A1 8/2011 Braun
2011/0267272 A1 11/2011 Meyer et al.
2011/0303521 A1 12/2011 Niu et al.
2012/0012446 A1 1/2012 Hwa
2012/0090973 A1 4/2012 Liu
2012/0098751 A1 4/2012 Liu
2012/0286701 A1 11/2012 Yang et al.
2012/0298496 A1 11/2012 Zhang
2012/0313856 A1 12/2012 Hsieh
2013/0100030 A1 4/2013 Los et al.
2013/0270090 A1 10/2013 Lee
2014/0071654 A1 3/2014 Chien
2014/0090967 A1 4/2014 Inagaki
2014/0098042 A1 4/2014 Kuo et al.
2014/0116865 A1 5/2014 Leong et al.
2014/0118264 A1 5/2014 Leong et al.

(56) References Cited

U.S. PATENT DOCUMENTS

| | | | |
|---|---|---|---|
| 2014/0151211 | A1 | 6/2014 | Zhang |
| 2014/0218851 | A1 | 8/2014 | Klein et al. |
| 2014/0252881 | A1 | 9/2014 | Dinh et al. |
| 2014/0291133 | A1 | 10/2014 | Fu et al. |
| 2014/0320436 | A1 | 10/2014 | Modarres et al. |
| 2014/0346025 | A1 | 11/2014 | Hendren et al. |
| 2014/0375141 | A1 | 12/2014 | Nakajima |
| 2015/0016038 | A1 | 1/2015 | Niu et al. |
| 2015/0083561 | A1 | 3/2015 | Han et al. |
| 2015/0090570 | A1 | 4/2015 | Kwan et al. |
| 2015/0090571 | A1 | 4/2015 | Leong et al. |
| 2015/0227207 | A1 | 8/2015 | Winter et al. |
| 2015/0243457 | A1 | 8/2015 | Niu et al. |
| 2015/0270073 | A1 | 9/2015 | Yarak, III et al. |
| 2015/0277559 | A1 | 10/2015 | Vescovi et al. |
| 2015/0287553 | A1 | 10/2015 | Welch et al. |
| 2015/0332874 | A1 | 11/2015 | Brock et al. |
| 2015/0378391 | A1 | 12/2015 | Huitema et al. |
| 2016/0049266 | A1 | 2/2016 | Stringer et al. |
| 2016/0093452 | A1 | 3/2016 | Zercoe et al. |
| 2016/0172129 | A1 | 6/2016 | Zercoe et al. |
| 2016/0189890 | A1 | 6/2016 | Leong et al. |
| 2016/0189891 | A1 | 6/2016 | Zercoe et al. |

FOREIGN PATENT DOCUMENTS

| | | |
|---|---|---|
| CN | 1533128 | 9/2004 |
| CN | 1542497 | 11/2004 |
| CN | 2672832 | 1/2005 |
| CN | 1624842 | 6/2005 |
| CN | 1855332 | 11/2006 |
| CN | 101051569 | 10/2007 |
| CN | 200986871 | 12/2007 |
| CN | 101146137 | 3/2008 |
| CN | 201054315 | 4/2008 |
| CN | 201084602 | 7/2008 |
| CN | 201123174 | 9/2008 |
| CN | 201149829 | 11/2008 |
| CN | 101315841 | 12/2008 |
| CN | 201210457 | 3/2009 |
| CN | 101465226 | 6/2009 |
| CN | 101494130 | 7/2009 |
| CN | 101502082 | 8/2009 |
| CN | 201298481 | 8/2009 |
| CN | 101546667 | 9/2009 |
| CN | 101572195 | 11/2009 |
| CN | 101800281 | 8/2010 |
| CN | 101807482 | 8/2010 |
| CN | 201655616 | 11/2010 |
| CN | 102110542 | 6/2011 |
| CN | 102119430 | 7/2011 |
| CN | 201904256 | 7/2011 |
| CN | 102163084 | 8/2011 |
| CN | 201927524 | 8/2011 |
| CN | 201945951 | 8/2011 |
| CN | 201945952 | 8/2011 |
| CN | 201956238 | 8/2011 |
| CN | 102197452 | 9/2011 |
| CN | 202008941 | 10/2011 |
| CN | 202040690 | 11/2011 |
| CN | 102280292 | 12/2011 |
| CN | 102375550 | 3/2012 |
| CN | 102496509 | 6/2012 |
| CN | 10269527 | 8/2012 |
| CN | 202372927 | 8/2012 |
| CN | 102683072 | 9/2012 |
| CN | 202434387 | 9/2012 |
| CN | 102955573 | 3/2013 |
| CN | 102956386 | 3/2013 |
| CN | 103000417 | 3/2013 |
| CN | 103165327 | 6/2013 |
| CN | 103180979 | 6/2013 |
| CN | 103377841 | 10/2013 |
| CN | 103489986 | 1/2014 |
| CN | 103681056 | 3/2014 |
| CN | 203520312 | 4/2014 |
| CN | 203588895 | 5/2014 |
| CN | 103839715 | 6/2014 |
| CN | 103839722 | 6/2014 |
| CN | 103903891 | 7/2014 |
| CN | 103956290 | 7/2014 |
| CN | 204102769 | 1/2015 |
| DE | 2530176 | 1/1977 |
| DE | 3002772 | 7/1981 |
| DE | 29704100 | 4/1997 |
| EP | 0441993 | 8/1991 |
| EP | 1835272 | 9/2007 |
| EP | 1928008 | 6/2008 |
| EP | 2022606 | 6/2010 |
| EP | 2426688 | 3/2012 |
| EP | 2664979 | 11/2013 |
| FR | 2147420 | 3/1973 |
| FR | 2911000 | 7/2008 |
| FR | 2950193 | 3/2011 |
| GB | 1361459 | 7/1974 |
| JP | S50115562 | 9/1975 |
| JP | S60055477 | 3/1985 |
| JP | S61172422 | 10/1986 |
| JP | S62072429 | 4/1987 |
| JP | S63182024 | 11/1988 |
| JP | H0422024 | 4/1992 |
| JP | H0520963 | 1/1993 |
| JP | H0524512 | 8/1993 |
| JP | H09204148 | 8/1997 |
| JP | H10312726 | 11/1998 |
| JP | H11194882 | 7/1999 |
| JP | 2000057871 | 2/2000 |
| JP | 2000339097 | 12/2000 |
| JP | 2001100889 | 4/2001 |
| JP | 2002260478 | 9/2002 |
| JP | 2002298689 | 10/2002 |
| JP | 2003522998 | 7/2003 |
| JP | 2005108041 | 4/2005 |
| JP | 2006164929 | 6/2006 |
| JP | 2006185906 | 7/2006 |
| JP | 2006521664 | 9/2006 |
| JP | 2006277013 | 10/2006 |
| JP | 2006344609 | 12/2006 |
| JP | 2007514247 | 5/2007 |
| JP | 2007156983 | 6/2007 |
| JP | 2008021428 | 1/2008 |
| JP | 2008100129 | 5/2008 |
| JP | 2008191850 | 8/2008 |
| JP | 2008533559 | 8/2008 |
| JP | 2009181894 | 8/2009 |
| JP | 2010061956 | 3/2010 |
| JP | 2010244088 | 10/2010 |
| JP | 2010244302 | 10/2010 |
| JP | 2011065126 | 3/2011 |
| JP | 2011150804 | 8/2011 |
| JP | 2011524066 | 8/2011 |
| JP | 2012043705 | 3/2012 |
| JP | 2012063630 | 3/2012 |
| JP | 2012098873 | 5/2012 |
| JP | 2012134064 | 7/2012 |
| JP | 2012186067 | 9/2012 |
| JP | 2012230256 | 11/2012 |
| JP | 2014017179 | 1/2014 |
| JP | 2014216190 | 11/2014 |
| JP | 2014220039 | 11/2014 |
| KR | 20150024201 | 3/2015 |
| TW | 200703396 | 1/2007 |
| TW | M334397 | 6/2008 |
| TW | 201108284 | 3/2011 |
| TW | 201108286 | 3/2011 |
| TW | M407429 | 7/2011 |
| TW | 201246251 | 11/2012 |
| TW | 201403646 | 1/2014 |
| WO | WO9744946 | 11/1997 |
| WO | WO2005/057320 | 6/2005 |
| WO | WO 2006/022313 | 3/2006 |
| WO | WO2008/045833 | 4/2008 |
| WO | WO2009/005026 | 1/2009 |

(56) References Cited

FOREIGN PATENT DOCUMENTS

| | | |
|---|---|---|
| WO | WO 2012/011282 | 1/2012 |
| WO | WO2012/027978 | 3/2012 |
| WO | WO2014175446 | 10/2014 |

OTHER PUBLICATIONS

Elekson, "Reliable and Tested Wearable Electronics Embedment Solutions," http://www.wearable.technology/our-technologies, 3 pages, at least as early as Jan. 6, 2016.

* cited by examiner

900

LOW TRAVEL SWITCH ASSEMBLY

CROSS-REFERENCE TO RELATED APPLICATION

This application is a nonprovisional patent application and claims the benefit of U.S. Provisional Patent Application No. 62/003,455, filed May 27, 2014 and titled "Low Travel Switch Assembly," the disclosure of which is hereby incorporated herein in its entirety.

FIELD OF THE INVENTION

Embodiments described herein may relate generally to a switch for an input device, and may more specifically relate to a low travel switch assembly for a keyboard or other input device.

BACKGROUND OF THE DISCLOSURE

Many electronic devices (e.g., desktop computers, laptop computers, mobile devices, and the like) include a keyboard as one of its input devices. There are several types of keyboards that are typically included in electronic devices. These types are mainly differentiated by the switch technology that they employ. One of the most common keyboard types is the dome-switch keyboard. A dome-switch keyboard includes at least a key cap, a layered electrical membrane, and an elastic dome disposed between the key cap and the layered electrical membrane. When the key cap is depressed from its original position, an uppermost portion of the elastic dome moves or displaces downward (from its original position) and contacts the layered electrical membrane to cause a switching operation or event. When the key cap is subsequently released, the uppermost portion of the elastic dome returns to its original position, and forces the key cap to also move back to its original position.

In addition to facilitating a switching event, a typical elastic dome also provides tactile feedback to a user depressing the key cap. A typical elastic dome provides this tactile feedback by behaving in a certain manner (e.g., by changing shape, buckling, unbuckling, etc.) when it is depressed and released over a range of distances. This behavior is typically characterized by a force-displacement curve that defines the amount of force required to move the key cap (while resting over the elastic dome) a certain distance from its natural position.

It is often desirable to make electronic devices and keyboards smaller. To accomplish this, some components of the device may need to be made smaller. Moreover, certain movable components of the device may also have less space to move, which may make it difficult for them to perform their intended functions. For example, a typical key cap is designed to move a certain maximum distance when it is depressed. The total distance from the key cap's natural (undepressed) position to its farthest (depressed) position is often referred to as the "travel" or "travel amount." When a device is made smaller, this travel may need to be smaller. However, a smaller travel requires a smaller or restricted range of movement of a corresponding elastic dome, which may interfere with the elastic dome's ability to operate according to its intended force-displacement characteristics and to provide suitable tactile feedback to a user.

SUMMARY OF THE DISCLOSURE

A low travel switch assembly and systems and methods for using the same are provided. The electrical connection made within the keyboard or input device to interact with the electronic device may be made, at least in part, by a low travel dome switch formed within the low travel switch assembly of the keyboard. The dome may deform by pressing a key cap, in contact with the dome, to contact an electrically communicative layer (e.g., a membrane) for completing an electrical circuit, and ultimately providing an input the electronic device utilizing the dome. The dome may provide a user with the tactile feel or "click" associated with pressing the key cap of the keyboard when providing input the electronic device. The tactile feel and/or the force required to deform the dome may be altered by "tuning" the dome. Tuning the dome may be accomplished by forming voids, openings or tuning members within the dome. Additionally, elongated protrusions may be formed on the dome and may extend, at least partially, into the tuning members to also alter the tactile feel and/or the force required to deform the dome. The inclusion of the tuning members and/or elongated protrusion may allow a manufacturer of the input device utilizing the dome to finely tune the dome, and ultimately the switch assembly for the electronic device, to have desired operational characteristics (e.g., tactile feel, deformation force).

One embodiment may include a key of a keyboard. The key may comprise a key cap, and a low travel dome positioned beneath the key cap, and operative to collapse when a force is exerted on the low travel dome by the key cap. The low travel dome may comprise a top portion, and a group of arms extending from the top portion to a perimeter of the low travel dome and at least partially defining a tuning member located between two of the group of arms. The low travel dome may also comprise a group of elongated protrusions. Each of the group of elongated protrusions may extend from one of the top portion, or one of the group of arms. At least one of the group of elongated protrusions may extend into the tuning member.

Another embodiment may include a low travel dome. The low travel dome may comprises a group of arms extending between a top portion and major sidewalls, and a group of tuning members. Each tuning member may be formed between two of the group of arms. The low travel dome may also comprise a group of elongated protrusions, where each elongated protrusion extends into a distinct tuning member. A force required to displace the low travel dome is determined based, at least in part, on the characteristics of at least one of, the group of arms, the group of tuning members, and the group of elongated protrusions.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

Figure 1:
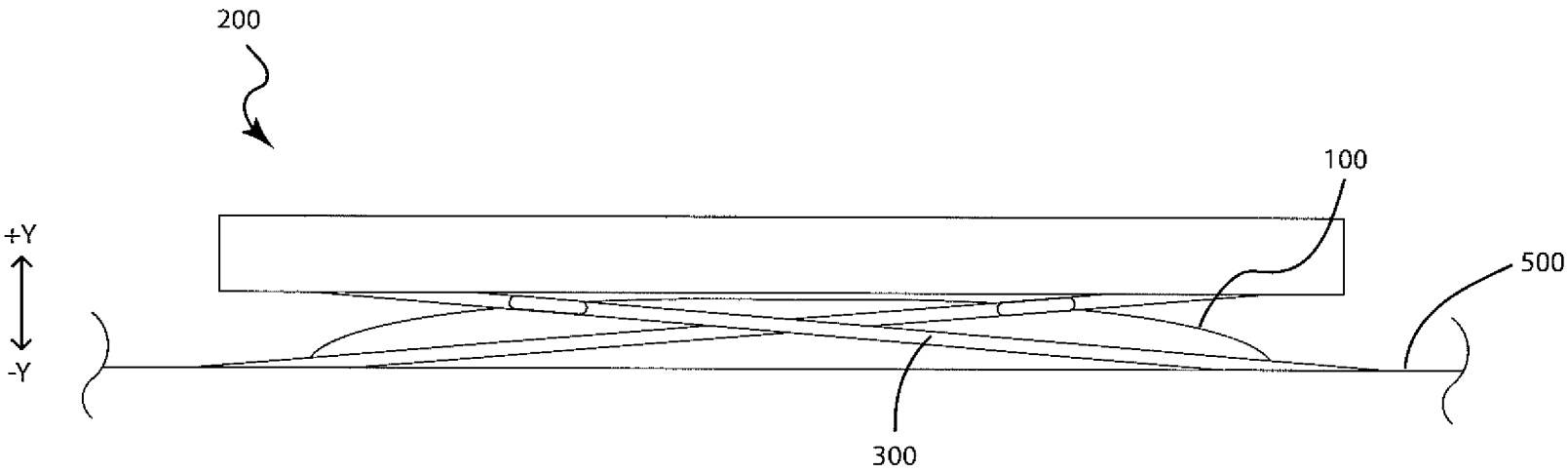
FIG. 1 is a cross-sectional view of a switch mechanism that includes a low travel dome, a key cap, a support structure, and a membrane, in accordance with at least one embodiment.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE DISCLOSURE

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to a switch for an input device, and may more specifically, to a low travel switch assembly for a keyboard or other input device.

The electrical connection made within the keyboard to interact with the electronic device may be made, at least in part, by a low travel dome switch formed within the switch or key assembly of the keyboard. The dome may deform by pressing a key cap, in contact with the dome, to contact an electrically communicative layer (e.g., a membrane) for completing an electrical circuit, and ultimately providing an input the electronic device utilizing the dome. The dome may provide a user with the tactile feel or "click" associated with pressing the key cap of the keyboard when providing input the electronic device. The tactile feel and/or the force required to deform the dome may be altered by "tuning" the dome. Tuning the dome may be accomplished by forming voids, openings or tuning members within the dome. Additionally, elongated protrusions may be formed on the dome and may extend, at least partially, into the tuning members to also alter the tactile feel and/or the force required to deform the dome. The inclusion of the tuning members and/or elongated protrusion may allow a manufacturer of the input device utilizing the dome to finely tune the dome, and ultimately the switch assembly for the electronic device, to have desired operational characteristics (e.g., tactile feel, deformation force).

A low travel switch assembly and systems and methods for using the same are described with reference to FIGS. 1-16. However, those skilled in the art will readily appreciate that the detailed description given herein with respect to these Figures is for explanatory purposes only and should not be construed as limiting.

FIG. 1 is a cross-sectional view of a switch mechanism that includes a low travel dome 100, a key cap 200, a support structure 300, and a membrane 500. Low travel dome 100 may be composed of any suitable type of material (e.g., metal, rubber, etc.) and may be elastic. For example, when a force is applied to low travel dome 100, it may compress or otherwise deform; in some embodiments this may permit an electrical contact to be made and registered as an input. Further, the stiffness of the dome, the force threshold under which it buckles, and other mechanical properties may affect the feel of a key associated with the dome and thus the user experience when a key (or other button, switch or input mechanism) is pressed.

Further, the dome's elasticity may cause it to return to its original shape when such an external force is subsequently removed. In some embodiments, low travel dome 100 may be one of a plurality of domes that may be a part of a dome pad or sheet (not shown). For example, low travel dome 100 may protrude from such a dome sheet in the +Y-direction (with respect to the orientation shown in FIG. 1). This dome sheet may reside beneath a set of key caps (e.g., key cap 200) of a keyboard (not shown) such that each dome of the dome pad may reside beneath a particular key cap of the keyboard.

As shown in FIG. 1, for example, low travel dome 100 may reside beneath key cap 200. Key cap 200 may be supported by support structure 300. Support structure 300 may be composed of any suitable material (e.g., plastic, metal, composite, and so on), and may provide mechanical stability to key cap 200. Support structure 300 may, for example, be a scissor mechanism or a butterfly mechanism that may contract and expand during depression and release of key cap 200, respectively. In some embodiments, rather than being a standalone scissor or butterfly mechanism, support structure 300 may be a part of an underside of key cap 200 that may press onto various portions of low travel dome 100. Regardless of the physical nature of support structure 300, key cap 200 may press onto low travel dome 100 to collapse the dome as mentioned above and thereby initiate an input, switching operation or other event via membrane 500 (described in more detail below with respect to FIGS. 5-8). Although not shown in FIG. 1, key cap 200 may also include a lower end portion that may be configured to contact an uppermost portion of low travel dome 100 during depression of key cap 200.

FIG. 1 shows key cap 200, low travel dome 100, support structure 300, and membrane 500 in an undepressed state (e.g., where each component may be in its respective natural position, prior to key cap 200 being depressed). Although FIG. 1 does not show key cap 200, low travel dome 100, support structure 300, and membrane 500 in a partially depressed or a fully depressed state, it should be appreciated that these components may occupy any of these states.

Figure 2:
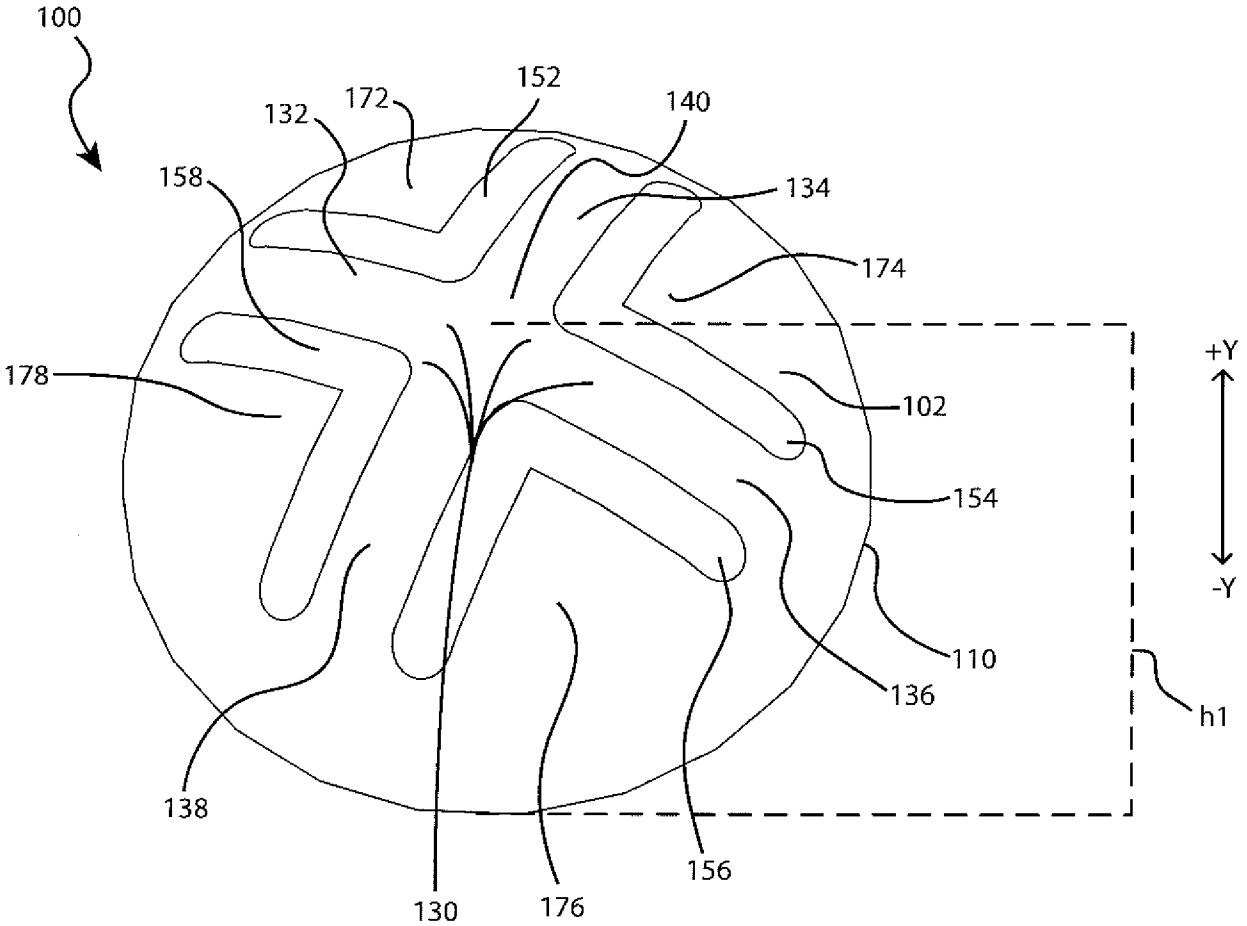
FIG. 2 is a perspective view of the low travel dome of FIG. 1, in accordance with at least one embodiment.
Figure 3:
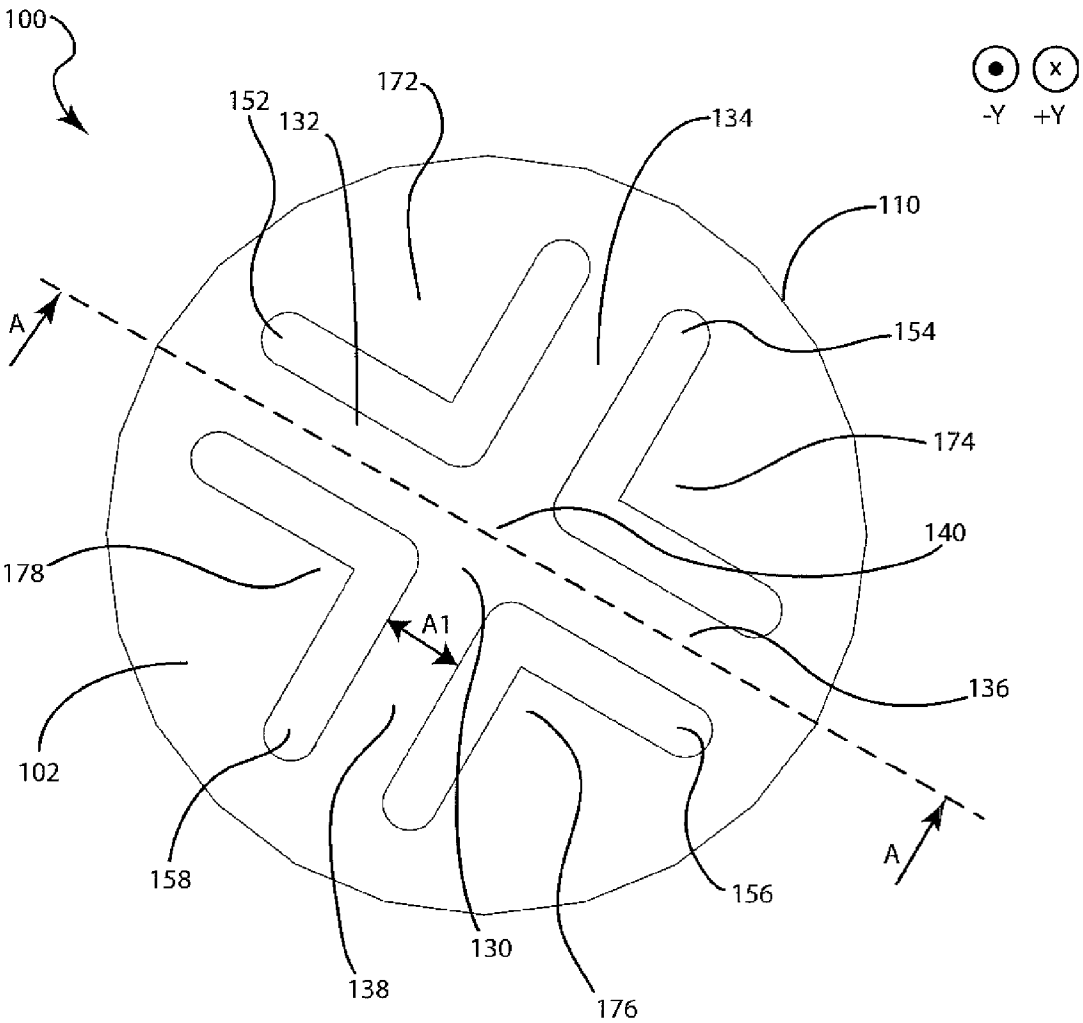
FIG. 3 is a top view of the low travel dome of FIG. 2, in accordance with at least one embodiment.

FIG. 2 is a perspective view of low travel dome 100. FIG. 3 is a top view of low travel dome 100. As shown in FIGS. 2 and 3, low travel dome 100 may include domed surface 102 having an upper portion 140 (e.g., that may include an uppermost portion of domed surface 102), a lower portion 110, and a set of tuning members 152, 154, 156, and 158 disposed between upper and lower portions 140 and 110. Domed surface 102 may have a hemispherical, semispherical, or convex profile, where upper portion 140 forms the top of the profile and lower portion 110 forms the base of the profile. Lower portion 110 can take any suitable shape such as, for example, a circular, an elliptical, rectilinear or another polygonal shape.

The physical attributes of low travel dome 100 may be tuned in any suitable manner. In some embodiments, tuning members 152, 154, 156, and 158 may be openings that may be integrated or formed in domed surface 102. That is, predefined portions (e.g., of a predefined size and shape) of domed surface 102 may be removed in order to control or tune low travel dome 100 such that it operates according to predetermined force-displacement curve characteristics.

Tuning members 152, 154, 156, and 158 may be spaced from one another such that one or more portions of domed surface 102 may extend from lower portion 110 of domed surface 102 to uppermost portion 140 of domed surface 102. For example, tuning members 152, 154, 156, and 158 may be evenly spaced from one another such that wall or arm portions 132, 134, 136, and 138 of domed surface 102 may form a cross-shaped (or X-shaped) portion 130 that may span from portion 110 to uppermost portion 140.

As shown in FIG. 2, portions 172, 174, 176, and 178 of domed surface 102 may each be partially contiguous with some parts of cross-shaped portion 130, but may also be partially separated from other parts of cross-shaped portion 130 due to tuning members 152, 154, 156, and 158.

Although FIGS. 2 and 3 show only four tuning members 152, 154, 156, and 158, in some embodiments, low travel dome 100 may include more or fewer tuning members. In some embodiments, the shape of each one of tuning members 152, 154, 156, and 158 may be tuned such that low travel dome 100 may operate according to predetermined force-displacement curve characteristics. In particular, each one of tuning members 152, 154, 156, and 158 may have a particular shape. As shown in FIG. 3, for example, when viewing low travel dome 100 from the top, each one of tuning members 152, 154, 156, and 158 may appear to have an L-shape. In some embodiments, tuning members 152, 154, 156, and 158 may have a pie or wedge shape.

Generally, it should be appreciated that the dome 100 shown in FIGS. 2-3 defines a set of opposed beams. Each beam is defined by a pair of arm segments and is generally contiguous across a surface of the dome 100. For example, a first beam may be defined by arm portions 134 and 138 while a second arm is defined by arm portions 132 and 136. Thus, the beams cross one another at the top of the dome but are generally opposed to one another (e.g., extend in different directions). In the present embodiment, the beams are opposed by 90 degrees, but other embodiments may have beams that are opposed or offset by different angles. Likewise, more or fewer beams may be present or defined in various embodiments.

The beams may be configured to collapse or displace when a sufficient force is exerted on the dome. Thus, the beams may travel downward according to a particular force-displacement curve; modifying the size, shape, thickness and other physical characteristics may likewise modify the force-displacement curve. Thus, the beams may be tuned in a fashion to provide a downward motion at a first force and an upward motion or travel at a second force. Thus, the beams may snap downward when the force exerted on a keycap (and thus on the dome) exceeds a first threshold, and may be restored to an initial or default position when the exerted force is less than a second threshold. The first and second thresholds may be chosen such that the second threshold is less than the first threshold, thus providing hysteresis to the dome 100.

It should be appreciated that the force curve for the dome 100 may be adjusted not only by adjusting certain characteristics of the beams and/or arm portions 132, 134, 136, 138, but also by modifying the size and shape of the tuning members 152, 154, 156, 158. For example, the tuning members may be made larger or smaller, may have different areas and/or cross-sections, and the like. Such adjustments to the tuning members 152, 154, 156, 158 may also modify the force-displacement curve of the dome 100.

In some embodiments, each one of arm portions 132, 134, 136, and 138 of low travel dome 100 may be tuned such that low travel dome 100 may operate according to predetermined force-displacement curve characteristics. In particular, each one of arm portions 132, 134, 136, and 138 may be tuned to have a thickness al (e.g., as shown in FIG. 3) that may be less than a predefined thickness. For example, thickness al may be less than or equal to about 0.6 millimeters in some embodiments, but may be thicker or thinner in others.

In some embodiments, the hardness of the material of low travel dome 100 may tuned such that low travel dome 100 may operate according to predetermined force-displacement curve characteristics. In particular, the hardness of the material of low travel dome 100 may be tuned to be greater than a predefined hardness such that cross-shaped portion 130 may not buckle as easily as if the material were softer.

Although FIGS. 2 and 3 show domed surface 102 having a cross-shaped portion 130, it should be appreciated that domed surface 102 may have a portion that may include any suitable number of arm portions. In some embodiments, rather than having four arm portions 132, 134, 136, 138, domed surface 102 may include more or fewer arm portions. In some embodiments, low travel dome 100 may be tuned such that it is operative to maintain key cap 200 and support structure 300 in their respective natural positions when key cap 200 is not undergoing a switch event (e.g., not being depressed). In these embodiments, low travel dome 100 may control key cap 200 (and support structure 300, if it is included) to operate according to predetermined force-displacement curve characteristics.

Regardless of how low travel dome 100 is tuned, when an external force is applied (for example, on or through key cap 200 of FIG. 1) to upper portion 140, cross-shaped portion 130 may move in the −Y-direction, and may cause arm portions 132, 134, 136, and 138 to change shape and buckle. As a result, an underside (e.g., directly opposite uppermost portion 140 of domed surface 102) may contact a portion of a membrane (e.g., membrane 500 of FIG. 1) of a keyboard when cross-shaped portion 130 moves a sufficient distance in the −Y-direction. In this manner, a switching operation or event may be triggered.

Figure 10:
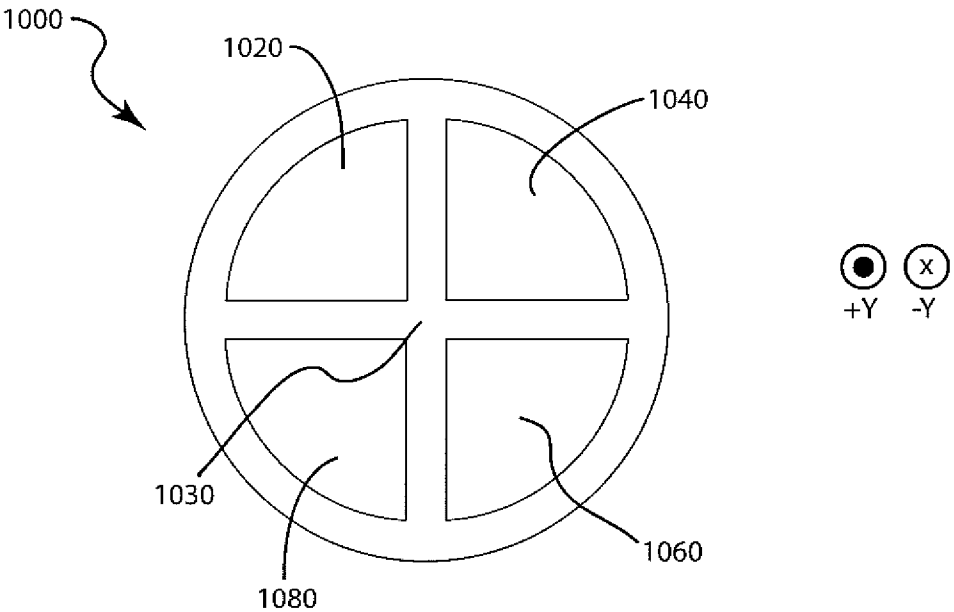
FIG. 10 is a top view of another low travel dome, in accordance with at least one embodiment.

FIG. 10 is a top view of an alternative low travel dome 1000 that may be similar to low travel dome 100, and that may be tuned to operate according to predetermined force-displacement curve characteristics. As shown in FIG. 10, low travel dome 1000 may include a cross-shaped portion 1030, and a set of tuning members 1020, 1040, 1060, and 1080. When viewing low travel dome 1000 from the top (e.g., as shown in FIG. 10), each one of tuning members 1020, 1040, 1060, and 1080 may appear to be pie-shaped.

Figure 11:
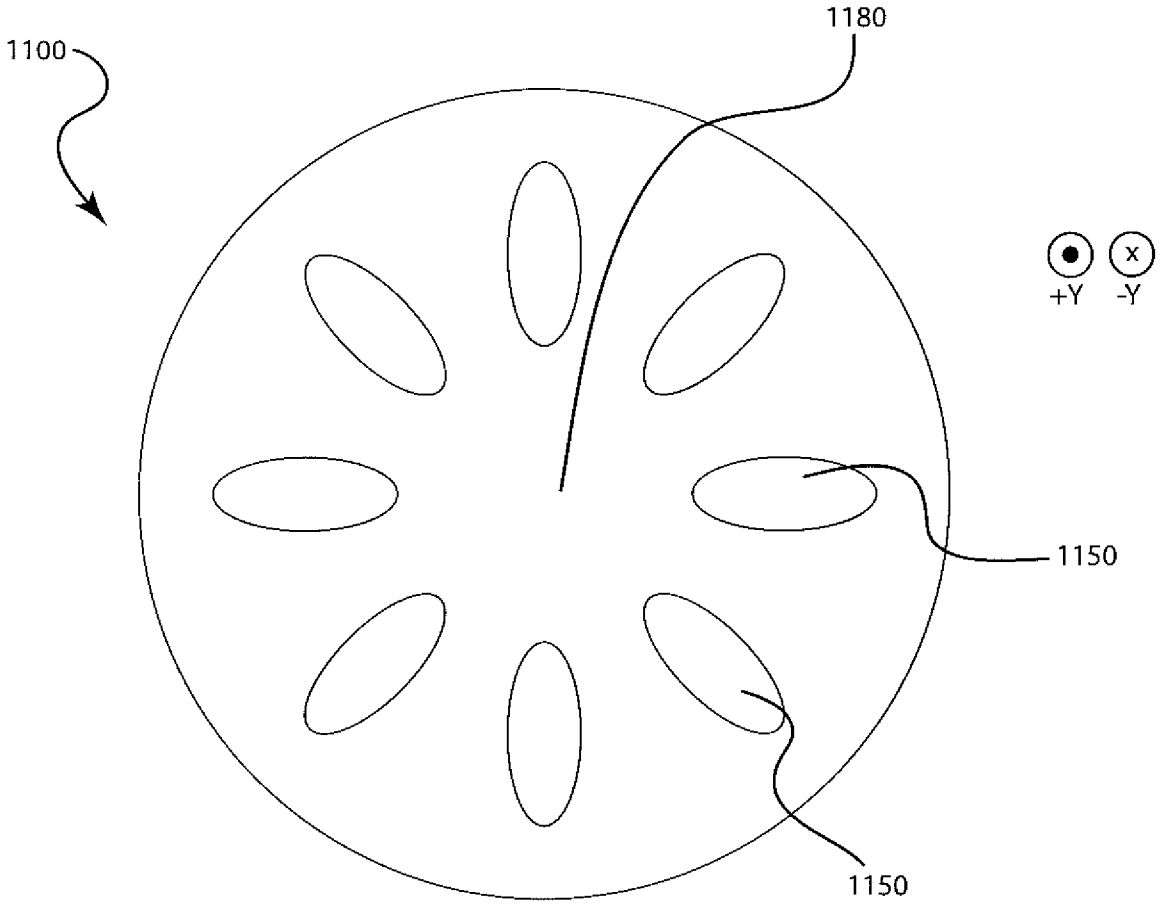
FIG. 11 is a top down view of yet another low travel dome, in accordance with at least one embodiment.

FIG. 11 is a top view of another alternative low travel dome 1100 that may be similar to low travel dome 100, and that may be tuned to operate according to predetermined force-displacement curve characteristics. As shown in FIG. 11, low travel dome 1100 may include a surface 1180, and a set of tuning members 1150. When viewing low travel dome 1100 from the top (e.g., as shown in FIG. 11), each one of tuning members 1150 may appear to have any suitable shape (e.g., elliptical, circular, rectangular, and the like).

Figure 4:
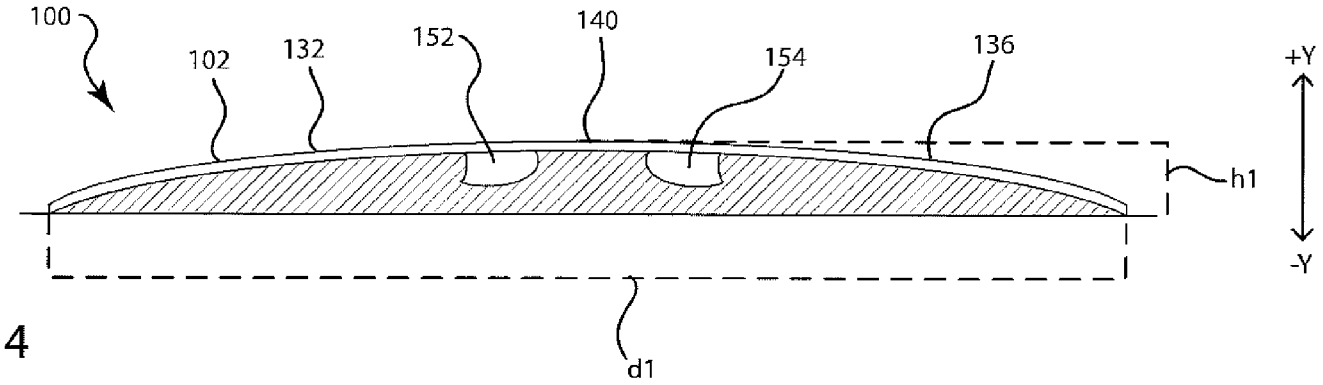
FIG. 4 is a cross-sectional view of the low travel dome of FIG. 3, taken from line A-A of FIG. 3, in accordance with at least one embodiment.

FIG. 4 is a cross-sectional view of low travel dome 100, taken from line A-A of FIG. 3. FIG. 4 is similar to FIG. 1, but does not show support structure 300. In some embodiments, support structure 300 may not be necessary, and a switching assembly may merely include key cap 200, low travel dome 100, and membrane 500. As shown in FIG. 4, arm portions 132 and 136 of cross-shaped portion 130 may form a contiguous arm portion that may span across domed surface 102.

Figure 5:
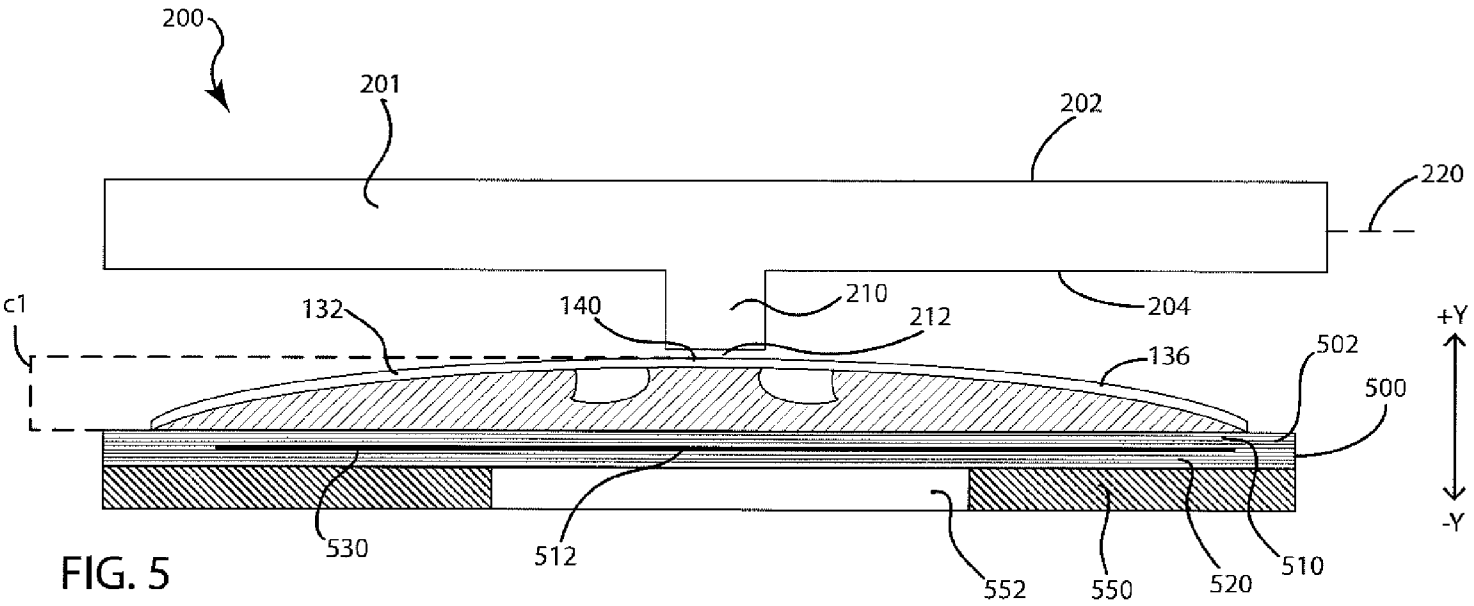
FIG. 5 is a cross-sectional view, similar to FIG. 4, of the low travel dome of FIG. 3, the low travel dome residing between the key cap and the membrane of FIG. 1 in a first state, in accordance with at least one embodiment.

FIG. 5 is a cross-sectional view, similar to FIG. 4, of low travel dome 100, with low travel dome 100 residing between key cap 200 and membrane 500 in a first state. Key cap 200, low travel dome 100, and membrane 500 may, for example, form one of the key switches or switch assemblies of a keyboard. As shown in FIG. 5, key cap 200 may include a body portion 201 and a contact portion 210. Body portion 201 may include a cap surface 202 and an underside 204, and contact portion 210 may include a contact surface 212. As shown in FIG. 5, key cap 200 may be in its natural position 220 (e.g., prior to cap surface 202 receiving any force (e.g., from a user)). Moreover, each one of low travel dome 100, and membrane 500 may be in their respective natural positions.

In some embodiments, membrane 500 may be a part of a printed circuit board ("PCB") that may interact with low travel dome 100. As described above with respect to FIG. 1, low travel dome 100 may be a component of a keyboard (not shown). In some embodiments, the keyboard may include a PCB and membrane that may provide key switching (e.g., when key cap 200 is depressed in the −Y-direction via an external force). Membrane 500 may include a top layer 510, a bottom layer 520, and a spacing 530 between top layer 510 and bottom layer 520. In some embodiments, membrane 500 may also include a support layer 550 that may include a through-hole 552 (e.g., a plated through-hole). Top and bottom layers 510 and 520 may reside above support layer 550. In some embodiments, top layer 510 and bottom layer 520 may each have a predefined thickness in the Y-direction, and spacing 530 may have a predefined height. Each one of top, bottom, and support layers 510, 520, and 550 may be composed of any suitable material (e.g., plastic, such as polyethylene terephthalate ("PET") polymer sheets, etc.). For example, each one of top and bottom layers 510 and 520 may be composed of PET polymer sheets that may each have a predefined thickness.

Top layer 510 may couple to or include a corresponding conductive pad (not shown), and bottom layer 520 may couple to or include a corresponding conductive pad (not shown). In some embodiments, each of these conductive pads may be in the form of a conductive gel. The gel-like nature of the conductive pads may provide improved tactile feedback to a user when, for example, the user depresses key cap 200. The conductive pad associated with top layer 510 may include corresponding conductive traces on an underside of top layer 510, and the conductive pad associated with bottom layer 520 may include conductive traces on an upper side of bottom layer 520. These conductive pads and corresponding conductive traces may be composed of any suitable material (e.g., metal, such as silver or copper, conductive gels, nanowire, and so on.).

As shown in FIG. 5, spacing 530 may allow top layer 510 to contact bottom layer 520 when, for example, low travel dome 100 buckles and cross-shaped portion 130 moves in the −Y-direction (e.g., due to an external force being applied to cap surface 202 of key cap 200). In particular, spacing 530 may allow the conductive pad associated with top layer 510 physical access to the conductive pad associated with bottom layer 520 such that their corresponding conductive traces may make contact with one another. This contact may then be detected by a processing unit (e.g., a chip of the electronic device or keyboard) (not shown), which may generate a code corresponding to key cap 200.

In some embodiments, key cap 200, low travel dome 100, and membrane 500 may be included in a surface-mountable package, which may facilitate assembly of, for example, an electronic device or keyboard, and may also provide reliability to the various components.

Although FIG. 5 shows a specific layered membrane that may be used to trigger a switch event, it should be appreciated that other mechanisms may also be used to trigger the switch event. For example, in some embodiments, low travel dome 100 may include a conductive material. In these embodiments, a separate conductive material may also reside beneath an underside of upper portion 140. When a keystroke occurs (e.g., when external force A is applied to key cap 200), the conductive material of low travel dome 100 may contact the separate conductive material, which may trigger the switch event.

Figure 6:
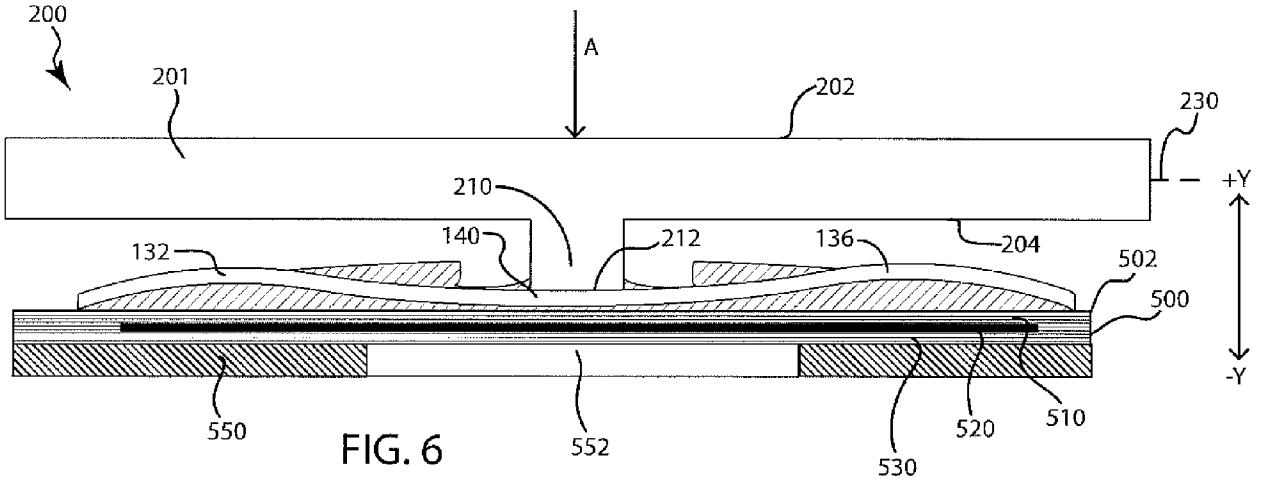
FIG. 6 is a cross-sectional view, similar to FIG. 5, of the low travel dome, the key cap, and the membrane of FIG. 5 in a second state, in accordance with at least one embodiment.
Figure 7:
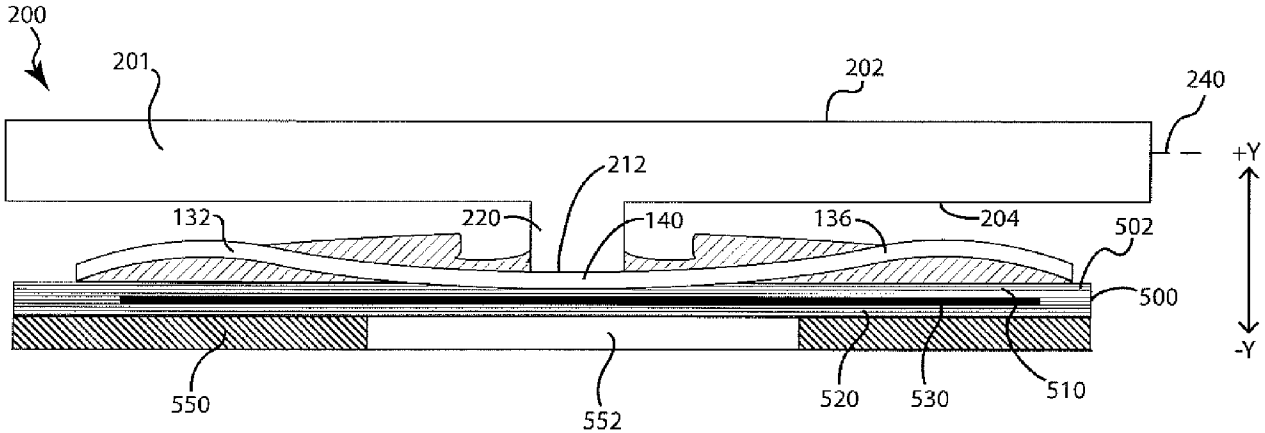
FIG. 7 is a cross-sectional view, similar to FIG. 5, of the low travel dome, the key cap, and the membrane of FIG. 5 in a third state, in accordance with at least one embodiment.
Figure 8:
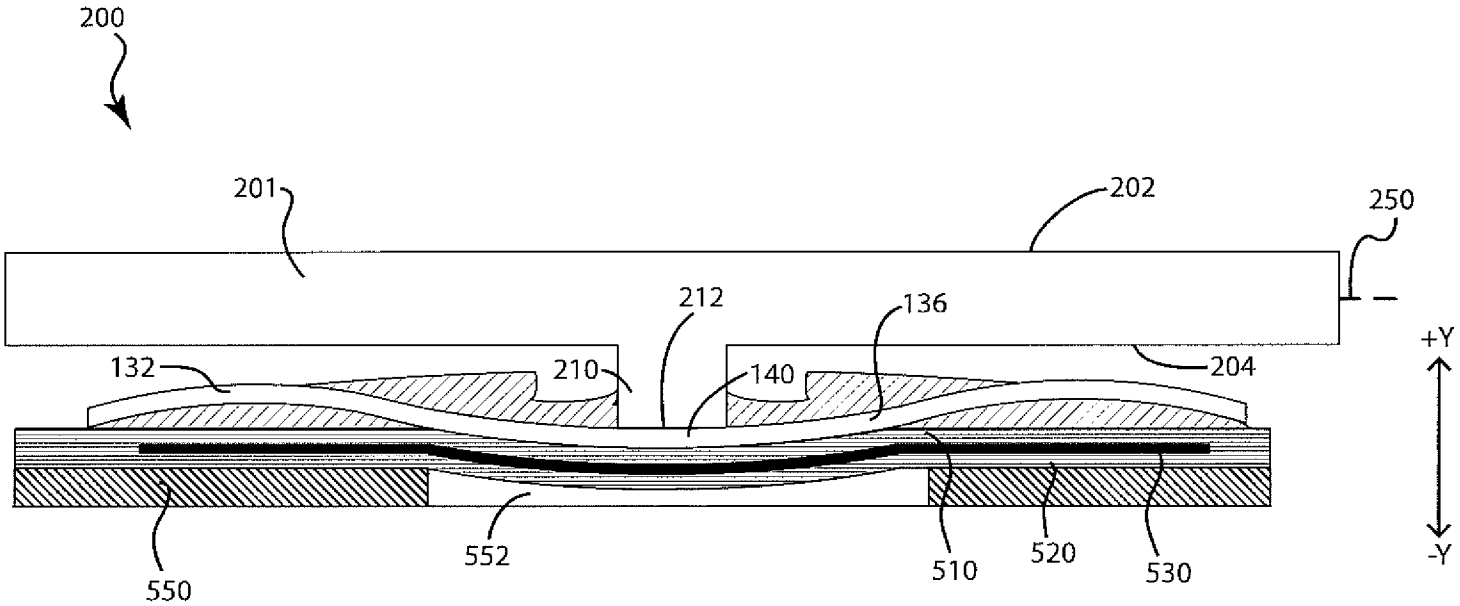
FIG. 8 is a cross-sectional view, similar to FIG. 5, of the low travel dome, the key cap, and the membrane of FIG. 5 in a fourth state, in accordance with at least one embodiment.
Figure 9:
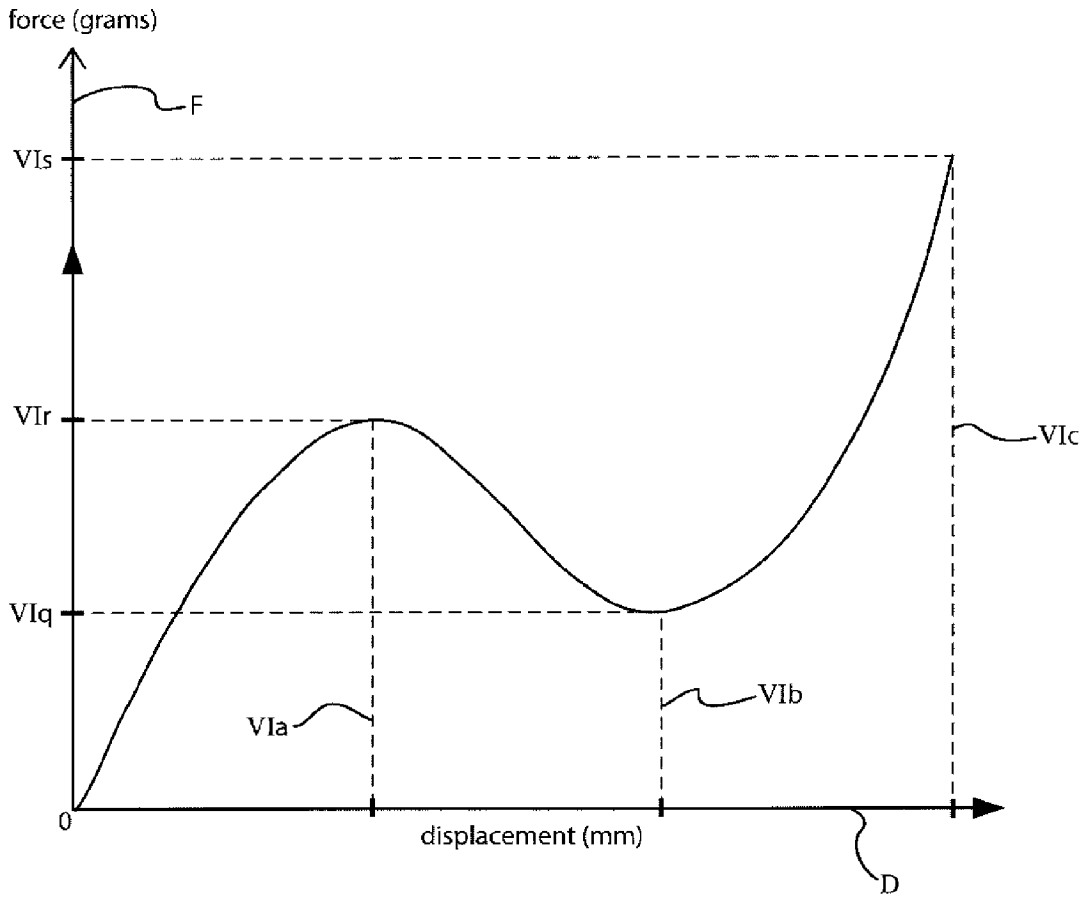
FIG. 9 shows a predefined force-displacement curve according to which the key cap and the low travel dome of FIGS. 5-8 may operate, in accordance with at least one embodiment.

As described above, low travel dome 100 may be tuned in any suitable manner such that low travel dome 100 (and thus, key cap 200) may operate according to predetermined force-displacement curve characteristics. FIGS. 6-8 are cross-sectional views, similar to FIG. 5, of low travel dome 100, key cap 20, and membrane 500 in second, third, and fourth states, respectively. FIG. 9 shows a predefined force-displacement curve 900 according to which key cap 200 and low travel dome 100 may operate. The F-axis may represent the force (in grams) that is applied to key cap 200, and the D-axis may represent the displacement of key cap 200 in response to the applied force.

The force required to depress key cap 200 from its natural position 220 (e.g., the position of key cap 200 prior to any force being applied thereto, as shown in FIG. 5) to a maximum displacement position 250 (e.g., as shown in FIG. 8) may vary. As shown in FIG. 9, for example, the force required to displace key cap 200 may gradually increase as key cap 200 displaces in the −Y-direction from natural position 220 (e.g., 0 millimeters) to a position 230 (e.g., VIa millimeters). This gradual increase in required force is at least partially due to the resistance of low travel dome 100 to change shape (e.g., the resistance of upper portion 140 to displace in the −Y-direction). The force required to displace key cap 200 to position 230 may be referred to as the operating or peak force.

When key cap 200 displaces to position 230 (e.g., VIa millimeters), low travel dome 100 may no longer be able to resist the pressure, and may begin to buckle (e.g., cross-shaped portion 130 may begin to buckle). The force that is subsequently required to displace key cap 200 from position 230 (e.g., VIa millimeters) to a position 240 (e.g., VIb millimeters) may gradually decrease.

When key cap 200 displaces to position 240 (e.g., VIb millimeters), an underside of upper portion 140 of low travel dome 100 may contact membrane 500 to cause or trigger a switch event or operation. In some embodiments, the underside may contact membrane 500 slightly prior to or slightly after key cap 200 displaces to position 240. When contact surface 107 contacts membrane 500, membrane 500 may provide a counter force in the +Y-direction, which may increase the force required to continue to displace key cap 200 beyond position 240. The force required to displace key cap 200 to position 240 may be referred to as the draw or return force.

When key cap 200 displaces to position 240, low travel dome 100 may also be complete in its buckling. In some embodiments, upper portion 140 may continue to displace in the −Y-direction, but cross-shaped portion 130 of low travel dome 100 may be substantially buckled. The force that is subsequently required to displace key cap 200 from position 240 (e.g., VIb millimeters) to position 250 (e.g., VIc millimeters) may gradually increase. Position 250 may be the maximum displacement position of key cap 200 (e.g., a bottom-out position). When the force (e.g., external force A) is removed from key cap 200, elastomeric dome 100 may then unbuckle and return to its natural position, and key cap may also return to natural position 220.

In some embodiments, the size or height of contact portion 210 may be defined to determine the maximum displacement position 250 or travel of key cap 200 in the −Y-direction. For example, the travel of key cap 200 may be defined to be about 0.75 millimeter, 1.0 millimeter, or 1.25 millimeters.

In addition to a cushioning effect provided by the gel-like conductive pads of top and bottom layers 510 and 520 to low travel dome 100 and key cap 200, in some embodiments, through-hole 552 may also provide a cushioning effect. As shown in FIG. 8, for example, when key cap 200 displaces to maximum displacement position 250 and low travel dome 100 completely buckles and presses onto top layer 510, bottom layer 520 may bend or otherwise interact with support layer 550 such that a portion of bottom layer 520 may enter into a void of through-hole 552. In this manner, key cap 200 may receive a cushioning effect, which may translate into improved tactile feedback for a user.

Figure 12:
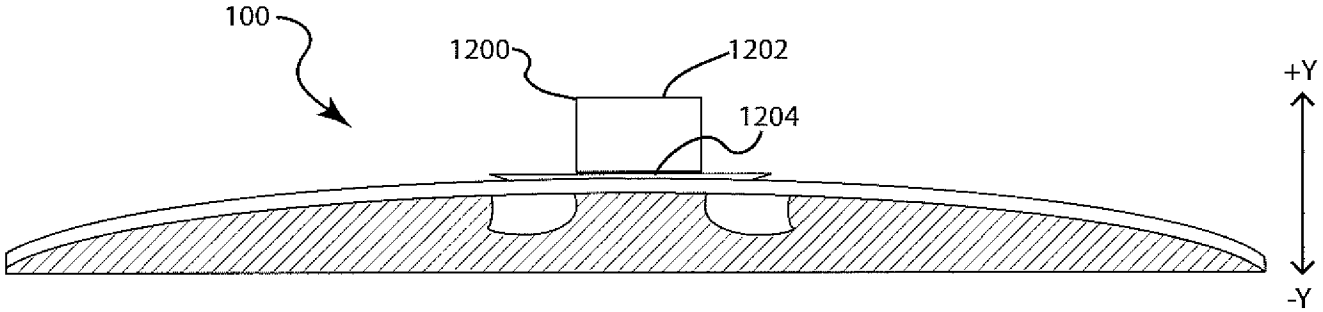
FIG. 12 is a cross-sectional view, similar to FIG. 4, of the low travel dome of FIG. 3 including a nub, in accordance with at least one embodiment.

In some embodiments, key cap 200 may or may not include contact portion 210. When key cap 200 does not include contact portion 210, for example, underside 204 of key cap 200 may not be sufficient to press onto upper portion 140 of cross-shaped portion 130. Thus, in these embodiments, low travel dome 100 may include a force concentrator nub that may contact underside 204 when a force is applied to cap surface 202 in the −Y-direction. FIG. 12 is a cross-sectional view, similar to FIG. 4, of low travel dome 100 including a nub 1200. As shown in FIG. 12, force concentrator nub 1200 may have a block shape having underside 1204 that may contact upper portion 140 of dome 100, and an upper side 1202 that may contact underside 204 of key cap 200. In this manner, when key cap 200 displaces in the −Y-direction due to an external force, underside 204 may press onto upper side 1202 and direct the external force onto upper portion 140.

Figure 13:
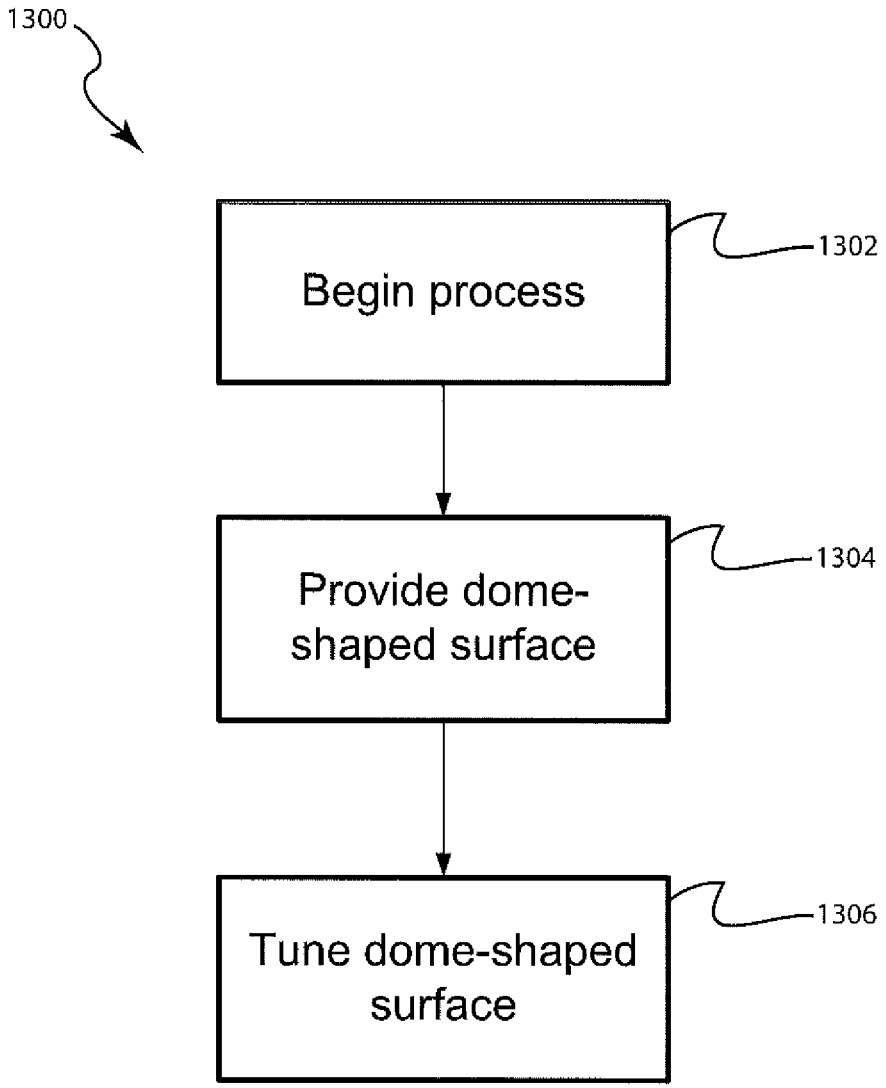
FIG. 13 is an illustrative process of providing the low travel dome of FIG. 2, in accordance with at least one embodiment.

FIG. 13 is an illustrative process 1300 of manufacturing low travel dome 100. Process 1300 may begin at operation 1302.

At step 1304, the process may include providing a dome-shaped surface. For example, operation 1304 may include providing a dome-shaped surface, such as domed surface 102 prior to any tuning members being integrated therewith.

At operation 1306, the process may include selectively removing a plurality of predefined portions of the dome-shaped surface to tune the dome-shaped surface to operate according to a predefined force-displacement curve characteristic. For example, operation 1306 may include forming openings or tuning members 152, 154, 156, and 158 at the plurality of predefined portions of the dome-shaped surface, each of the openings having a predefined shape, such as an L-shape or a pie shape. In some embodiments, operation 1306 may include forming a remaining portion of the dome-shaped surface that may appear to be cross-shaped. Moreover, in some embodiments, operation 1306 may include die cutting or stamping of the dome-shaped surface to create tuning members 152, 154, 156, and 158.

Figure 14:
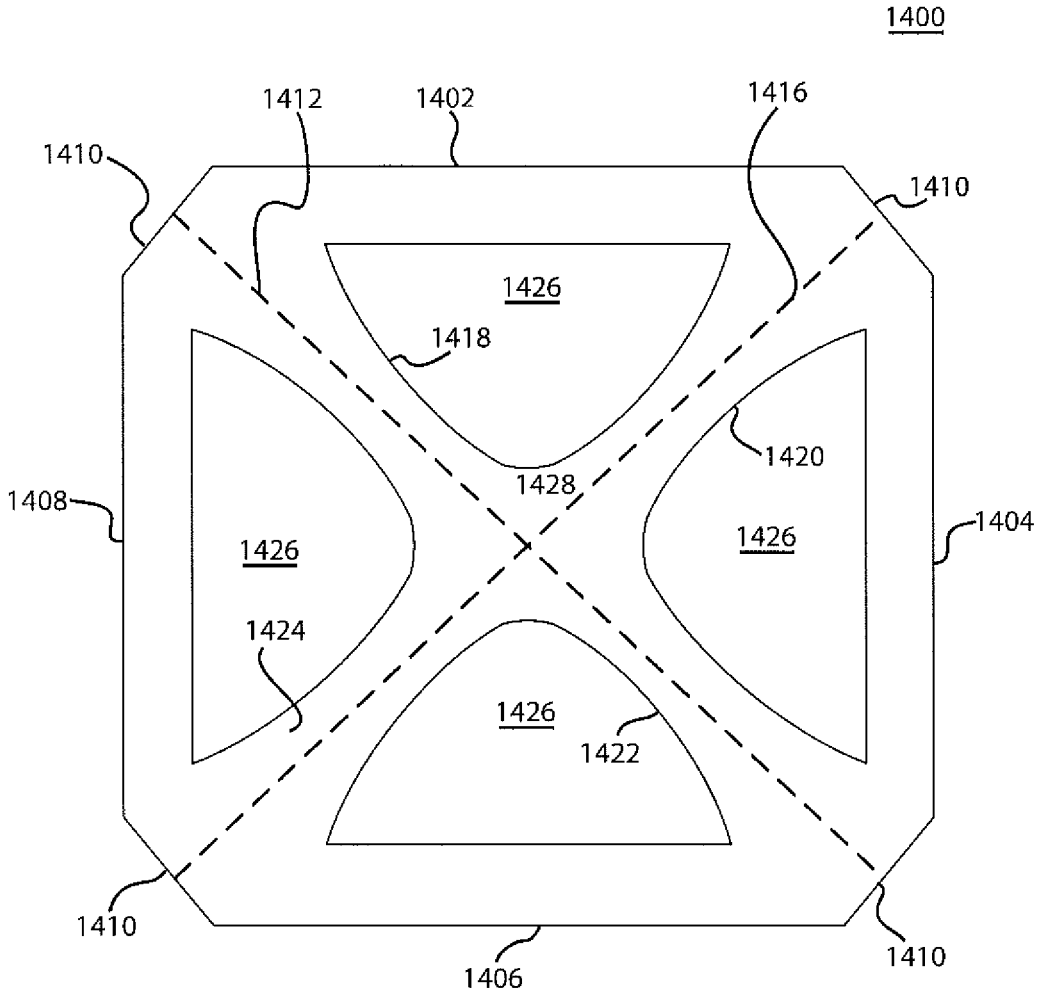
FIG. 14 is a top down view of another low travel dome, in accordance with at least one embodiment.

FIG. 14 illustrates yet another sample dome 1400 that may be employed in certain embodiments. This dome 1400 may be generally square or rectangular. That is, the major sidewalls 1402, 1404, 1406, 1408 may be straight and define all or the majority of an outer edge or surface of the dome 1400. The dome 1400 may have one or more angled edges 1410. Here, each of the four corners is angled. The angled edges 1410 may provide clearance for the dome 1400 during assembly of a key and/or keyboard with respect to adjacent domes, holding or retaining mechanisms, and the like. Further, the angled edges may provide additional surface contact with respect to an underlying membrane, thereby providing additional area to secure to the membrane in some embodiments. It should be appreciated that alternative embodiments may omit some or all of the angled edges 1410. Square and/or partly square bases, such as the one shown in FIG. 14, may be employed with any of the foregoing embodiments. Likewise, in some embodiments, a circular base (or base having another shape) may be employed with the arm structure shown in FIG. 14.

As shown in the embodiment of FIG. 14, two beams 1412, 1416 may extend between diagonally opposing angled edges 1410 (or corners, if there are no angled edges). Alternative embodiments may include more or fewer beams. Each beam 1412, 1416 may be thought of as being formed by multiple arms 1418, 1420, 1422, 1424. The arms 1418, 1420, 1422, 1424 meet at the top 1428 of the dome 1400. The shape of the arms may be varied by adjusting the amount of material and the shape of the material removed to form the tuning members 1426, which are essentially voids or apertures formed in the dome 1400. The interrelationship of the tuning members 1426 and beams/arms to generate a force-displacement curve has been previously discussed.

By employing a dome 1400 having a generally square or rectangular profile, the usable area for the dome under a square keycap may be maximized. Thus, the length of the beams 1412, 1416 may be increased when compared to a dome that is circular in profile. This may allow the dome 1400 to operate in accordance with a force-displacement curve that may be difficult to achieve if the beams are constrained to be shorter due to a circular dome shape. For example, the deflection of the beams (in either an upward or downward direction) may occur across a shorter period, once the necessary force threshold is reached. This may provide a crisper feeling, or may provide a more sudden depression or rebound of an associated key. Further, fine tuning of a force-displacement curve for the dome 1400 may be simplified since the length of the beams 1412, 1416 is increased.

Figure 15:
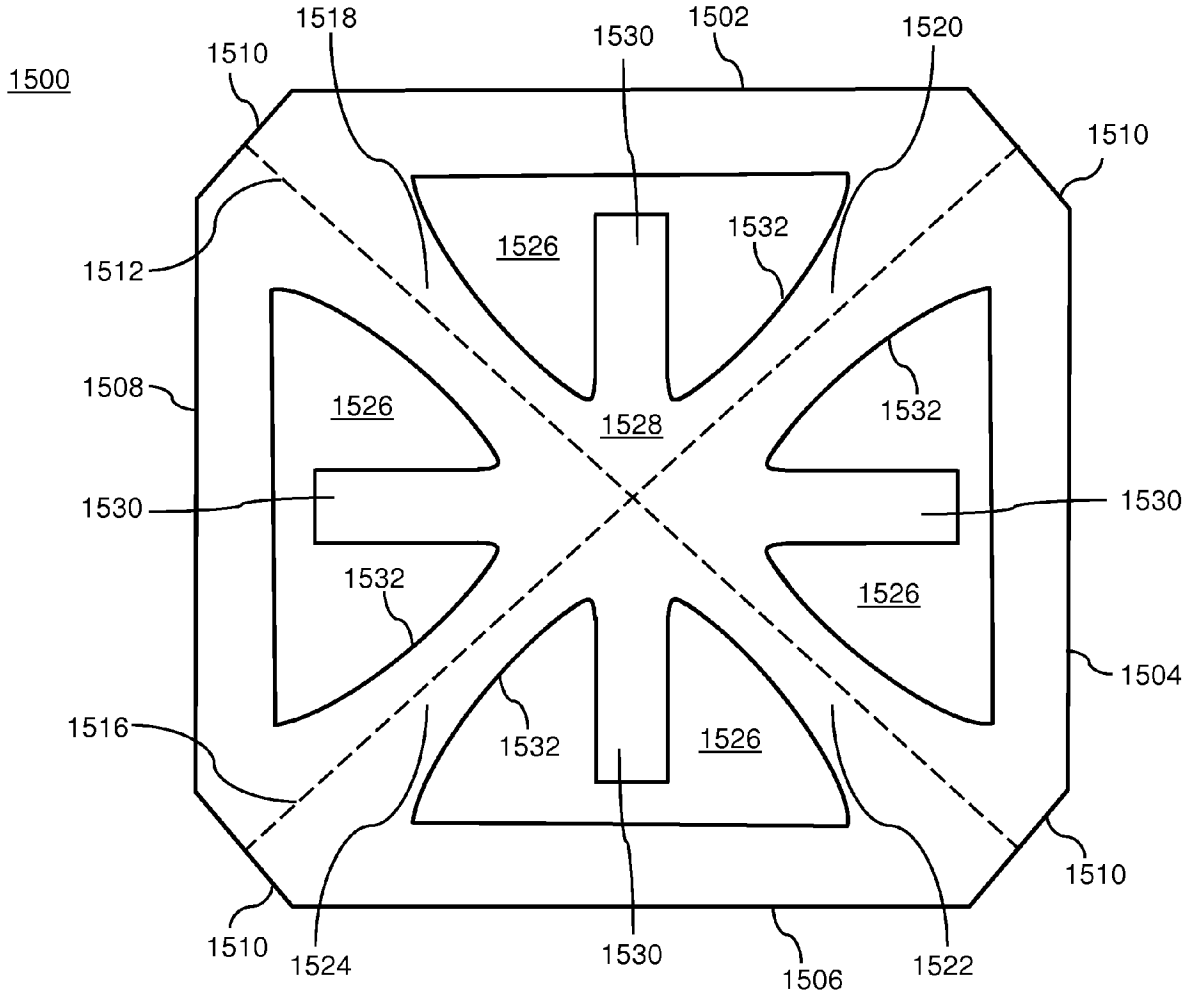
FIG. 15 is a top down view of yet another low travel dome, in accordance with at least one embodiment.

FIG. 15 illustrates another embodiment of a low travel dome 1500 that may be utilized in certain embodiments. As similarly shown and discussed with respect to FIG. 14, dome 1500 may be substantially square or rectangular. In one embodiment, major sidewalls 1502, 1504, 1506, 1508 may be substantially straight and define at least the majority of the outer edges or a perimeter of dome 1500. Additionally, and as similarly discussed with respect to FIG. 14, dome 1500 may include angled or arcuate corners 1510 between each of the major sidewalls 1502, 1504, 1506, 1508 for providing clearance for dome 1500 during assembly of a key and/or keyboard, and/or for providing additional surface contact with respect to underlying membrane of the and/or keyboard.

Also similar to dome 1400 of FIG. 14, dome 1500 may also include two beams 1512, 1516 extending diagonally across dome 1500, from respective angled corners 1510 positioned between major sidewalls 1502, 1504, 1506, 1508. Beams 1512, 1516 may be made up of a plurality of arms 1518, 1520, 1522, 1524 all converging and/or meeting at top 1528 of dome 1500. Further, dome 1500 may include a plurality of tuning members 1526 formed as voids or apertures through dome 1500, adjacent the plurality of arms 1518, 1520, 1522, 1524. The plurality of tuning members 1526, and specifically the geometry of the tuning members 1526, which ultimately affect the geometry of the plurality of arms 1518, 1520, 1522, 1524 may be associated with the force required to displace dome 1500 during operation. That is, as the geometry or size of each of the plurality of tuning members 1526 increases, the geometry or size of the plurality of arms 1518, 1520, 1522, 1524 may decrease. As a result of increasing size of the plurality of tuning members 1526, and ultimately decreasing the surface area and/or rigidity for dome 1500 by decreasing the size of the plurality of arms 1518, 1520, 1522, 1524, the required force to displace dome 1500 may also decrease. The opposite may also be true. That is, as the geometry or size of each of the plurality of tuning members 1526 decreases, the geometry or size of the plurality of arms 1518, 1520, 1522, 1524 may increase, which may ultimately increase the required force to displace dome 1500. In a non-limiting example shown in FIG. 15, the geometry of tuning members 1526 may include a width that may diverge and/or decrease as tuning members 1526 moves closer to top portion 1528. As shown in the example, the width of tuning members 1526 positioned adjacent major sidewalls 1502, 1504, 1506, 1508 of dome 1500 may be wider than a portion of tuning members 1526 positioned adjacent top portion 1528.

In comparison with FIG. 14, dome 1500 of FIG. 15 may also include a plurality of elongated protrusions 1530. As shown in FIG. 5, each of the plurality of elongated protrusions 1530 extend partially into a unique tuning member of the plurality of tuning members 1526. That is, each of the plurality of tuning members 1526 may include a substantially linear, elongated protrusion 1530 extending from perimeter 1532 of each tuning member 1526, where the elongated protrusion 1530 may extend partially into each of the plurality of tuning member 1526. As shown in FIG. 15, each of the plurality of elongated protrusions 1530 may be positioned adjacent to and/or extend from top 1528 of dome 1500. The inclusion of the plurality of elongated protrusions 1530 within dome 1500 may provide additional structural support and/or may vary the stiffness of dome 1500. For example, when compared to dome 1400 of FIG. 14, dome 1500 of FIG. 15 may require a greater force for deflection (in either upward or downward direction). In the non-limiting example, the stiffness and/or the increase in the required force for deflecting 1500 may be a result of the inclusion of elongated protrusions 1530 in dome 1500. As a result of the increased required force for deflection, a more crisp or sudden depression and/or rebound of the key may be realized when utilizing dome 1500 of FIG. 15.

In the non-limiting example shown in FIG. 15, and discussed herein, dome 1500 may include four distinct tuning members 1526 separated by arms 1518, 1520, 1522, 1524. However, it is understood that dome 1500 may include any number of tuning members 1526 formed in dome 1500. In another non-limiting example, dome 1500 may include two tuning members 1526. As a further non-limiting example, when dome 1500 includes two distinct tuning members 1526, tuning members 1526 may be positioned opposite one another on dome 1500 and may be separated by top portion 1528. In another non-limiting example where dome 1500 includes two distinct tuning members 1526, tuning members 1526 may be positioned adjacent one another on dome 1500, and may be separated by a single arm 1518, 1520, 1522, 1524 of dome 1500.

Although dome 1500, as shown in FIG. 15, includes elongated protrusions 1530 positioned within every tuning member 1526, it is understood that dome 1500 may not include elongated protrusions 1530 in all tuning members 1526. That is, elongated protrusions 1530 may be positioned only a portion of the tuning members 1526 of dome 1500. The position of elongated protrusions 1530 in tuning members 1526 and/or dome 1500 may influence and/or vary the stiffness and the force required for deflecting dome 1500, as discussed herein. In a non-limiting example, two elongated protrusions 1530 may be positioned in opposition tuning members 1526 formed in dome 1500.

Moreover, and as discussed herein, elongated protrusions 1530 may be positioned within predetermined tuning members 1526 of dome to increase the force for deflection of dome 1500 in certain areas. In a non-limiting example, two elongated protrusion 1530 may be positioned in adjacent tuning members 1526 of dome 1500. In the non-limiting example dome 1500 may require a higher force for deflection in the portion of dome 1500 including the two elongated protrusions 1530 positioned within the adjacent tuning members 1526, than the portion of dome 1500 that does not include elongated protrusions 1530.

Figure 16:
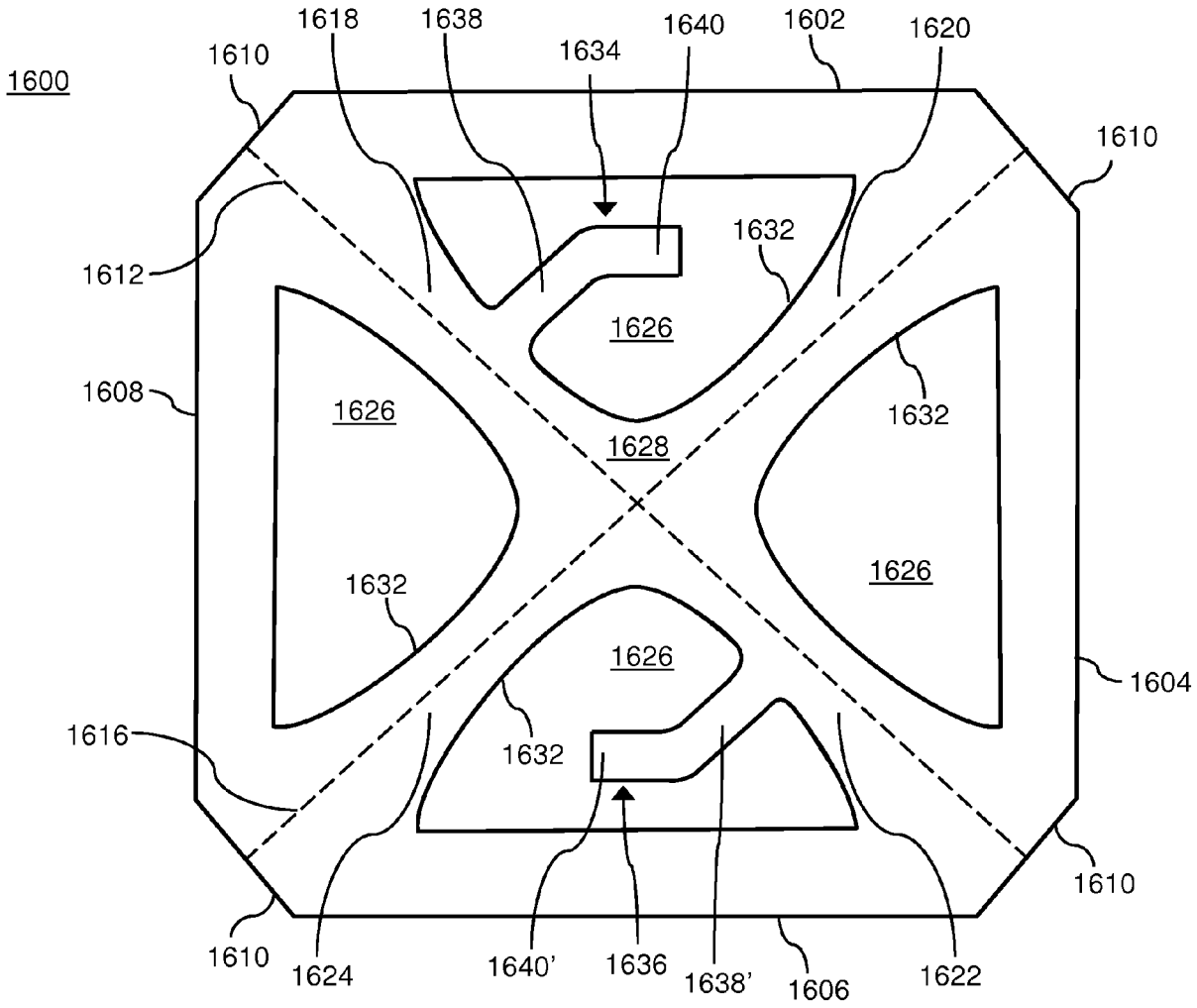
FIG. 16 is a top down view of an additional low travel dome, in accordance with at least one embodiment.

FIG. 16 illustrates yet another low travel dome 1600 that may be utilized in certain embodiments. As similarly discussed with respect to FIGS. 14 (e.g., dome 1400) and 15 (e.g., dome 1500), respectively, dome 1600 of FIG. 16 may be a square, rectangular, ellipses or other shapes, and may include substantially similar components or features as described with respect to previous embodiments (e.g., beams 1612, 1616, plurality of arms 1618, 1620, 1622, 1624, plurality of tuning members 1626). It is understood that similar components and features may function in a substantially similar fashion. Redundant explanation of these components has been omitted for clarity.

As shown in FIG. 16, dome 1600 may include at least one angled member 1634, 1636 extending at least partially into a tuning member 1626 of dome 1600. More specifically, dome 1600 may include two substantially angled members 1634, 1636 extending into two distinct tuning members 1626 positioned opposite to one another. The substantially angled members 1634, 1636 may be formed from two generally straight sub-members 1638, 1640 (or 1638', 1640') that join one another at a transition point and define an angle there between. First, sub-member 1638 may extend from arm 1618 as discussed herein. Second, sub-member 1640 may extend from and/or may be integrally formed with first, sub-member 1638. In a non-limiting example shown in FIG. 16, second, sub-member 1640 may extend from first, sub-member 1638 and may be substantially parallel to a portion of the perimeter 1632 of tuning member 1626.

The material used to form the sub-members 1638, 1640, the length and/or thickness of the sub-members 1638, 1640, and the angle formed at the transition point may all affect the stiffness of dome 1600 and thus the force required to collapse or displace dome 1600. For example, as the thickness of the sub-members 1638, 1640 increases, the stiffness of dome 1600 may also increase. It should be appreciated that the angle defined at the transition point by sub-members 1638, 1640 may vary between embodiments. In a non-limiting example shown in FIG. 16, the angle defined at the transition point by sub-members 1638, 1640 may be an obtuse angle.

As shown in FIG. 16, angled member 1634 may define an edge of tuning member 1626, and may extend from an arm 1618. The angled member 1634 extends perpendicularly from an axis of arm 1618, where the axis may be in substantial alignment with beam 1612. Positioning of angled member 1634 with respect to tuning member 1626 may vary in other embodiments. Additionally, angled member 1636 may be positioned within any tuning member 1626. As shown in FIG. 16, both arm 1618 and arm 1622 may be positioned along and/or outwardly from beam 1612 of dome 1600. The angled members 1634, 1636 may be positioned in opposite tuning members 1626 such that dome 1600 may remain relatively symmetrical, although this is not required in all embodiments. More specifically, based on the positioning of angled members 1634, 1636, dome 1600 may include a substantially uniform weight distribution and stiffness distribution, and may also include a relatively symmetrical physical configuration.

Although only two angled members 1634, 1636 are shown in FIG. 16, more or fewer angled members 1634, 1636 may be utilized in dome 1600, as similarly discussed herein with respect to elongated protrusions 1530 of FIG. 15. The number of angled members 1634, 1636 implemented in dome 1600 may be dependent on the required stiffness for dome 1600. That is, similar to the elongated protrusions 1530 of dome 1500 in FIG. 15, angled members 1634, 1636 may provide additional stiffness to dome 1600, which may increase the required force for deflecting (in either upward or downward direction) dome 1600 during operation. As such, the number of angled members 1634, 1636 included in dome 1600, in addition to the dimensions of tuning members 1626, may be determined based on a desired force for actuating dome 1600 when dome 1600 is utilized in a key and/or keyboard, as discussed herein. In a non-limiting example, dome 1600 may include four distinct angled members 1634, 1636, where each of the angled members 1634, 1636 may be positioned within distinct tuning members 1626 of dome 1600. Other embodiments may have more or fewer angled members and more or fewer such members positioned with any given tuning member.

As similarly discussed herein with respect to elongated protrusions 1530 of FIG. 15, the positioning of angled members 1634, 1636 within dome 1600 may vary the stiffness and/or the required force for deflecting dome 1600. Additionally, angled members 1634, 1636 may be positioned within a portion of dome 1600 that may require increased stiffness and/or an increased required deflection force for dome 1600. For example, angled members 1634, 1636 may be positioned in adjacent tuning members 1626 formed in a first half of dome 1600, where the first half of dome 1600 may require an increase in stiffness and/or deflection force when compared to a second half of dome 1600. In the example, angled members 1634, 1636 may not be positioned within tuning members 1626 formed in the second half of dome 1600 to differentiate the stiffness and required deflection force between the first half and the second half of dome 1600.

Additional characteristics of dome 1600 may also influence a force required to displace dome 1600. In a non-limiting example, characteristics of arms 1618, 1620, 1622, 1624 of dome 1600 may influence the force required to displace or distress dome 1600. The characteristics of arms 1618, 1620, 1622, 1624 of dome 1600 may include a width, an thickness, a length and/or a position of arms 1618, 1620, 1622, 1624 of dome 1600. In the non-limiting example, the force required to displace dome 1600 may increase when the width and/or the thickness of arms 1618, 1620, 1622, 1624 of dome 1600 increase and/or when the length of the arms 1618, 1620, 1622, 1624 decrease.

In another non-limiting example, characteristics of tuning members 1626 of dome 1600 may influence the force required to displace, collapse or otherwise distress dome 1600. The characteristics of tuning members 1626 of dome 1600 may include a size and/or a geometry of tuning members 1626, as discussed herein; any or all of such characteristics may impact the force-displacement curve of the dome 1600. In one non-limiting example, the force required to displace dome 1600 may decrease in response to an increase in the size of tuning members 1626, as discussed herein, and vice versa.

In a further non-limiting example, characteristics of elongated protrusions 1630 and/or angled member 1634, 1636 of dome 1600 may influence the force required to displace or distress dome 1600. The characteristics of elongated protrusions 1630 and/or angled member 1634, 1636 of dome 1600 may include a width, a thickness, a length, a geometry and/or a position of elongated protrusions 1630 and/or angled member 1634, 1636 of dome 1600, and or all of which may be adjusted to vary the force-displacement curve of the dome 1600. In the non-limiting example, the force required to displace dome 1600 may increase when the width, the thickness and/or the length of elongated protrusions 1630 and/or angled member 1634, 1636 of dome 1600 increase.

In addition to influencing the force required to displace or distress dome 1600, the characteristics of the various portions of dome 1600 may also influence the force-displacement curve (see, FIG. 9) of dome 1600. That is, the characteristics of arms 1618, 1620, 1622, 1624, tuning members 1626 and/or elongated protrusions 1630 of dome 1600 may also influence the force-displacement curve, and the force transitions for depressing dome 1600 to various positions (see, FIG. 9; displacement without buckling, buckling, and so on). In a non-limiting example, the characteristics of the various portions of dome 1600 may vary (e.g., increase the slope) the gradual increase of force dome 1600 may withstand as keycap 200 moves from natural position 220 to position 230 (see, FIG. 9).

In some embodiments, the angled members may extend downwardly, toward a base of the dome. The angle at which such members extend may vary between embodiments. Typically, the angle is chosen such that an end of the angled member may contact a substrate beneath the dome at approximately the same time the dome collapses, although alternative embodiments may have such a connection made shortly before or after the dome collapse.

Further, the end of the angled member(s) contacting the dome may be electrically conductive and an electrical contact may be formed on the substrate at the point where the angled member(s) touch during the dome collapse. An electrical trace or path may extend between the angled members or from one or more angled members to a sensor or other electrical component, which may be remotely located. A second electrical path may extend from the sensor or electrical component to the contact(s) on the substrate. Thus, when the angled member(s) contact the substrate, a circuit may be closed, and the sensor or other electrical component may register the closing of the circuit. In this manner, the angled member or members may be used to complete a circuit and signify an input, such as a depression of a keycap above the dome.

While there have been described a low travel switch assembly and systems and methods for using the same, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up and "down," "front" and "back," "top" and "bottom," "left" and "right," "length" and "width," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Moreover, an electronic device constructed in accordance with the principles of the invention may be of any suitable three-dimensional shape, including, but not limited to, a sphere, cone, octahedron, or combination thereof.

Therefore, those skilled in the art will appreciate that the invention can be practiced by other than the described embodiments, which are presented for purposes of illustration rather than of limitation.

What is claimed is:

1. A key of a keyboard, comprising:
- a key cap; and
- a low travel dome positioned beneath the key cap, and operative to collapse when a force is exerted on the low travel dome by the key cap, the low travel dome comprising:
  - a top portion;
  - a group of arms extending from the top portion to a perimeter of the low travel dome and configured to buckle when a force is applied to the key cap; and
  - a group of elongated protrusions, each of the group of elongated protrusions extending into a distinct tuning member of a group of tuning members, each tuning member located between two arms of the group of arms.

2. The key of claim 1, wherein each of the group of elongated protrusion is substantially linear.

3. The key of claim 1, wherein at least one of the group of elongated protrusions extends from a perimeter of the tuning members.

4. The key of claim 1, wherein each of the group of elongated protrusion comprises an angled member.

5. The key of claim 4, wherein the angled member comprises:
- a first, straight sub-member; and
- a second, straight sub-member joined to the first, straight sub-member,
- wherein the first, straight sub-member and the second, straight sub-member define an angle therebetween.

6. The key of claim 5, wherein the angle defined between the first, straight sub-member and the second, straight sub-member is an obtuse angle.

7. The key of claim 5, wherein the second, straight sub-member extends parallel to a portion of a perimeter of the tuning member.

8. The key of claim 4, wherein the angled member extends perpendicularly from each arm of the group of arms.

9. The key of claim 1, wherein the group of tuning members comprises four distinct tuning members spaced evenly within the low travel dome.

10. The key of claim 9, wherein each of the tuning members comprises an identical geometry, the geometry comprising a width diverging toward the top portion of the low travel dome.

11. The key of claim 9 further comprising:
- a support structure coupled to and operative to support the key cap; and
- a membrane positioned below the low travel dome, the low travel dome operative to contact the membrane in a depressed state.

12. The key of claim 1, wherein the group of tuning members comprises two distinct tuning members positioned at least one of:
- opposite one another, or
- adjacent one another.

13. A low travel dome comprising:
- a group of arms extending between a top portion and major sidewalls and configured to collapse in response to a force received at the top portion;
- a group of tuning members, each tuning member formed between two of the group of arms; and
- a group of elongated protrusions, each elongated protrusion extending into a distinct tuning member; wherein
- a force required to displace the low travel dome is determined based, at least in part, on the characteristics of at least one of:
  - the group of arms;
  - the group of tuning members; and
  - the group of elongated protrusion.

14. The low travel dome of claim 13, wherein the characteristics of the group of arms further comprises at least one of:
- a width of each arm of the group of arms;
- a thickness of each arm of the group of arms;
- a length of each arm of the group of arms; and
- a position of each arm of the group of arms.

15. The low travel dome of claim 14, wherein the force required to displace the low travel dome increases in response to at least one of:
- an increase in the width of each arm of the group of arms;
- an increase in the thickness of each arm of the group of arms; and
- a decrease in the length of each arm of the group of arms.

16. The low travel dome of claim 13, wherein the characteristics of the group of tuning members further comprises at least one of:
- a size of each tuning member of the group of tuning members; and
- a geometry of each tuning member of the group of tuning members.

17. The low travel dome of claim 16, wherein the force required to displace the low travel dome decreases in response to an increase in the size of each of the group of tuning members.

18. The low travel dome of claim 13, wherein the characteristics of the group of elongated protrusions further comprises at least one of:

a width of each elongated protrusion of the group of elongated protrusions;

a thickness of each elongated protrusion of the group of elongated protrusions;

a length of each elongated protrusion of the group of elongated protrusions;

a geometry of each elongated protrusion of the group of elongated protrusions; and a position of each elongated protrusion of the group of elongated protrusions within the group of tuning members.

19. The low travel dome of claim 18, wherein the force required to displace the low travel dome increases in response to at least one of:

an increase in the width of each arm of the group of arms;

an increase in the thickness of each arm of the group of arms; and an increase in the length of each arm of the group of arms.

20. The low travel dome of claim 18, wherein the geometry of each elongated protrusion of the group of elongated protrusions further comprises at least one of:

a substantially linear member; and an angled member.

* * * * *